US008272507B1

(12) United States Patent
Crump et al.

(10) Patent No.: US 8,272,507 B1
(45) Date of Patent: Sep. 25, 2012

(54) KIT OF A PLURALITY OF DETACHABLE POCKETS, A DETACHABLE POCKET, AND ASSOCIATED METHODS

(75) Inventors: Brenda Crump, Burleson, TX (US); Michael Deese, Colleyville, TX (US)

(73) Assignee: Visionary Products, Inc., Fortworth, TX (US)

( * ) Notice: Subject to any disclaimer, the term of this patent is extended or adjusted under 35 U.S.C. 154(b) by 0 days.

(21) Appl. No.: 13/352,251

(22) Filed: Jan. 17, 2012

Related U.S. Application Data

(60) Provisional application No. 61/566,423, filed on Dec. 2, 2011.

(51) Int. Cl.
*B65D 69/00* (2006.01)

(52) U.S. Cl. ..... 206/223; 206/38; 224/158; 224/576; 224/901

(58) Field of Classification Search ..... 206/38, 206/223, 320; 150/113; 190/110; 224/101, 224/245, 258, 575, 576, 901; 383/38–40
See application file for complete search history.

(56) References Cited

U.S. PATENT DOCUMENTS

| | | | |
|---|---|---|---|
| 13,608 | A | 9/1855 | Weimer |
| 1,055,811 | A | 3/1913 | Scholl |
| 1,559,114 | A | 10/1925 | Maranville |
| 1,562,454 | A | 11/1925 | Jenkins |
| 1,744,122 | A | 1/1930 | Keeling |
| 1,747,603 | A | 2/1930 | Ruth |
| 1,980,621 | A | 11/1934 | Innis |
| 2,030,135 | A | 2/1936 | Carpenter |
| 2,053,085 | A | 9/1936 | Hunter |
| 2,268,777 | A | 1/1942 | Scholl |
| 2,292,024 | A | 8/1942 | Dreher |
| 2,408,152 | A | 9/1946 | Porcelli |
| 2,475,417 | A | 7/1949 | Wysowski |
| 2,553,825 | A | 5/1951 | Langs |
| 2,573,363 | A | 10/1951 | Ruddick |

(Continued)

FOREIGN PATENT DOCUMENTS

DE 2430092 1/1976

(Continued)

OTHER PUBLICATIONS

Photographs of Bodpockets "The Pocket Your Wear" MP3 Bodpocket Grey/Black Print in Faux SnakeSkin; including invoice of product purchase dated Nov. 30, 2011; 10 pages.

(Continued)

*Primary Examiner* — Luan K Bui
(74) *Attorney, Agent, or Firm* — Bracewell & Giuliani LLP

(57) ABSTRACT

Embodiments of the present invention provide a kit of a plurality of detachable pockets, a detachable pocket and associated methods. An embodiment of a kit has a container with a plurality of detachable pockets positioned therein. Each pocket within the container be used to hold personal items on a person's clothing or skin by adherence of the pocket to a person's skin or clothing. Example embodiments of the detachable pocket include a pocket body having a pocket layer and a flange. Both the pocket layer and the flange can be fabricated from one or more materials. The pocket layer can have an end to be attached as open and defining an open end and three sides having the flange disposed there around and to which adhesive is disposed. The pocket can be attached and removed as desired.

11 Claims, 20 Drawing Sheets

U.S. PATENT DOCUMENTS

| | | | | | |
|---|---|---|---|---|---|
| 2,619,961 | A | | 12/1952 | Stewart | |
| 2,633,440 | A | | 3/1953 | Scholl | |
| 2,634,778 | A | | 4/1953 | Wax | |
| 2,732,065 | A | | 1/1956 | Marchese | |
| 2,763,885 | A | | 9/1956 | Lyons | |
| 2,851,805 | A | | 9/1958 | Allen | |
| 2,985,970 | A | | 5/1961 | McCarthy | |
| 3,059,350 | A | | 10/1962 | Price | |
| 3,063,448 | A | | 11/1962 | Scholl | |
| 3,092,103 | A | | 6/1963 | Mower | |
| 3,253,591 | A | | 5/1966 | Scholl | |
| 3,255,748 | A | | 6/1966 | Wallerstein | |
| 3,257,678 | A | | 6/1966 | Batchelder et al. | |
| 3,276,449 | A | | 10/1966 | Morgan | |
| 3,280,818 | A | | 10/1966 | Pankey et al. | |
| 3,283,888 | A | | 11/1966 | Scott | |
| 3,348,541 | A | | 10/1967 | Loebeck | |
| 3,380,178 | A | | 4/1968 | Haig | |
| 3,438,062 | A | | 4/1969 | Dobell | |
| 3,487,832 | A | | 1/1970 | Spence | |
| 3,547,950 | A | | 12/1970 | Gander | |
| 3,548,420 | A | | 12/1970 | Spence | |
| 3,561,140 | A | | 2/1971 | Ludwig | |
| 3,616,156 | A | | 10/1971 | Scholl | |
| 3,747,776 | A | * | 7/1973 | Gross | 206/527 |
| 3,840,012 | A | | 10/1974 | Rushton, Jr. | |
| 3,840,901 | A | | 10/1974 | Eyster | |
| 3,903,620 | A | | 9/1975 | Gillet | |
| 3,905,113 | A | | 9/1975 | Jacob | |
| 3,937,218 | A | | 2/1976 | Gaylord, Jr. | |
| 3,947,896 | A | | 4/1976 | Taylor | |
| 3,985,383 | A | | 10/1976 | Yonkers | |
| 4,047,310 | A | | 9/1977 | Sunoo | |
| 4,079,526 | A | | 3/1978 | Fukuoka | |
| 4,094,316 | A | | 6/1978 | Nathanson | |
| 4,139,409 | A | | 2/1979 | Macken | |
| 4,156,293 | A | | 5/1979 | Off | |
| 4,210,245 | A | | 7/1980 | Dodge | |
| 4,263,951 | A | * | 4/1981 | Siegel | 150/113 |
| 4,266,300 | A | | 5/1981 | Partridge | |
| D266,201 | S | | 9/1982 | Berman | |
| 4,350,726 | A | | 9/1982 | Berry, Jr. | |
| 4,367,732 | A | | 1/1983 | Poulsen et al. | |
| 4,379,881 | A | | 4/1983 | Peck | |
| 4,386,642 | A | * | 6/1983 | Durbin | 190/110 |
| 4,389,801 | A | | 6/1983 | Sharrock et al. | |
| 4,439,935 | A | | 4/1984 | Kelly | |
| 4,463,789 | A | * | 8/1984 | Leiserson | 224/245 |
| 4,553,550 | A | | 11/1985 | Hattori | |
| 4,561,123 | A | | 12/1985 | Hull | |
| 4,561,124 | A | | 12/1985 | Thompson | |
| D283,579 | S | | 4/1986 | Peterson | |
| 4,602,390 | A | | 7/1986 | Morera et al. | |
| 4,619,055 | A | | 10/1986 | Davidson | |
| 4,641,641 | A | | 2/1987 | Strock | |
| 4,651,355 | A | | 3/1987 | White | |
| 4,656,673 | A | | 4/1987 | Easton | |
| 4,674,133 | A | | 6/1987 | Oschner | |
| 4,710,981 | A | | 12/1987 | Sanchez | |
| 4,773,409 | A | | 9/1988 | Cilento et al. | |
| 4,801,213 | A | * | 1/1989 | Frey et al. | 383/3 |
| 4,831,666 | A | | 5/1989 | Denman | |
| 4,839,206 | A | | 6/1989 | Waldenberger | |
| 4,842,931 | A | | 6/1989 | Zook | |
| 4,867,748 | A | | 9/1989 | Samuelsen | |
| 4,889,234 | A | | 12/1989 | Sorensen et al. | |
| 4,890,608 | A | | 1/1990 | Steer | |
| 4,899,395 | A | | 2/1990 | Spector | |
| 4,920,577 | A | | 5/1990 | Scharf | |
| 4,924,608 | A | | 5/1990 | Mogonye | |
| 4,926,568 | A | | 5/1990 | Coffman | |
| 4,926,883 | A | | 5/1990 | Strock | |
| 4,942,992 | A | | 7/1990 | Fischer et al. | |
| 4,947,867 | A | | 8/1990 | Keeton | |
| 4,990,548 | A | | 2/1991 | Gillis et al. | |
| 5,014,354 | A | | 5/1991 | Dumont | |
| 5,020,547 | A | | 6/1991 | Strock | |
| 5,031,640 | A | | 7/1991 | Spitzer | |
| 5,032,103 | A | | 7/1991 | Larsson | |
| 5,054,127 | A | | 10/1991 | Zevchak | |
| 5,067,178 | A | | 11/1991 | Katchka | |
| 5,075,900 | A | | 12/1991 | Chittenden | |
| 5,096,030 | A | * | 3/1992 | Espinosa et al. | 190/110 |
| 5,098,421 | A | | 3/1992 | Zook | |
| 5,130,185 | A | | 7/1992 | Ness | |
| 5,160,315 | A | | 11/1992 | Heinecke et al. | |
| 5,172,424 | A | | 12/1992 | Adkins | |
| 5,188,124 | A | | 2/1993 | Feret | |
| 5,199,498 | A | | 4/1993 | Knudsen | |
| 5,233,768 | A | | 8/1993 | Humphreys | |
| 5,244,136 | A | | 9/1993 | Collaso | |
| 5,244,523 | A | | 9/1993 | Tollini | |
| 5,266,371 | A | | 11/1993 | Sugii et al. | |
| 5,268,228 | A | | 12/1993 | Orr | |
| 5,281,186 | A | | 1/1994 | Buckley et al. | |
| 5,347,657 | A | | 9/1994 | Unsell | |
| D355,489 | S | | 2/1995 | Almond | |
| 5,453,083 | A | | 9/1995 | Kasahara | |
| 5,454,743 | A | | 10/1995 | Simonson | |
| 5,462,519 | A | | 10/1995 | Carver | |
| 5,477,633 | A | | 12/1995 | Leinberger | |
| 5,497,789 | A | | 3/1996 | Zook | |
| 5,499,403 | A | | 3/1996 | Harrigan | |
| 5,515,544 | A | | 5/1996 | Hosking | |
| 5,539,020 | A | | 7/1996 | Bracken et al. | |
| 5,545,129 | A | | 8/1996 | Snook | |
| 5,547,465 | A | | 8/1996 | Powell | |
| 5,551,612 | A | | 9/1996 | Hochfeld | |
| D375,611 | S | | 11/1996 | Cannon | |
| 5,592,687 | A | | 1/1997 | Lajeunesse | |
| 5,592,689 | A | | 1/1997 | Matthews | |
| 5,603,679 | A | | 2/1997 | Reis | |
| 5,622,761 | A | | 4/1997 | Cole | |
| 5,636,406 | A | | 6/1997 | Strong | |
| 5,643,187 | A | | 7/1997 | Naestoft | |
| 5,664,342 | A | | 9/1997 | Buchsenschuss | |
| D385,354 | S | | 10/1997 | Fabricant | |
| D385,356 | S | | 10/1997 | Fabricant | |
| 5,678,273 | A | | 10/1997 | Porcelli | |
| 5,683,354 | A | | 11/1997 | Levy | |
| D388,592 | S | | 1/1998 | Minden | |
| 5,718,224 | A | | 2/1998 | Muchin | |
| 5,718,622 | A | | 2/1998 | Jones | |
| 5,732,412 | A | | 3/1998 | Holden | |
| D393,726 | S | | 4/1998 | Sweeney | |
| 5,737,775 | A | | 4/1998 | Schwartz | |
| 5,755,611 | A | | 5/1998 | Noble | |
| 5,765,231 | A | | 6/1998 | Leonard | |
| 5,771,605 | A | | 6/1998 | Safdie | |
| 5,774,889 | A | | 7/1998 | Gochanour | |
| 5,782,672 | A | | 7/1998 | Woodley | |
| 5,788,660 | A | | 8/1998 | Resnik | |
| 5,802,612 | A | | 9/1998 | Hosking | |
| 5,806,103 | A | | 9/1998 | McCracken | |
| 5,809,476 | A | | 9/1998 | Ryan | |
| 5,809,576 | A | | 9/1998 | Huston | |
| 5,815,876 | A | | 10/1998 | Overseth | |
| 5,827,213 | A | | 10/1998 | Jensen | |
| D404,135 | S | | 1/1999 | Dunshee | |
| D405,237 | S | | 2/1999 | Maslowski | |
| 5,864,969 | A | | 2/1999 | Mauch | |
| 5,879,771 | A | | 3/1999 | Kypreos | |
| 5,890,486 | A | | 4/1999 | Mitra et al. | |
| 5,891,957 | A | | 4/1999 | Hansen et al. | |
| 5,894,623 | A | | 4/1999 | Thill | |
| 5,896,580 | A | | 4/1999 | Aldrich et al. | |
| 5,899,207 | A | | 5/1999 | Scheinberg | |
| 5,914,166 | A | | 6/1999 | Le | |
| 5,916,653 | A | | 6/1999 | Kunstadter et al. | |
| 5,920,902 | A | | 7/1999 | Crampton et al. | |
| D413,011 | S | | 8/1999 | Yokoyama | |
| 5,933,873 | A | | 8/1999 | Curran et al. | |
| 5,946,732 | A | | 9/1999 | Richards | |
| 5,954,245 | A | | 9/1999 | Kluesner | |
| 5,965,225 | A | | 10/1999 | Torres | |
| D416,676 | S | | 11/1999 | Fitzgerald | |
| 5,993,375 | A | | 11/1999 | Engel | |

| | | | |
|---|---|---|---|
| 5,996,252 | A | 12/1999 | Cougar |
| 6,004,670 | A | 12/1999 | Kobe et al. |
| 6,006,751 | A | 12/1999 | Spitzer |
| D419,282 | S | 1/2000 | Nickle et al. |
| 6,014,771 | A | 1/2000 | Kirven |
| 6,029,273 | A | 2/2000 | McCrane |
| D423,211 | S | 4/2000 | Giliberti |
| D424,787 | S | 5/2000 | Hinton |
| 6,055,748 | A | 5/2000 | Harrison |
| 6,090,471 | A | 7/2000 | Abrams |
| 6,098,854 | A | 8/2000 | Apple |
| 6,106,852 | A | 8/2000 | Vineberg |
| 6,112,961 | A | 9/2000 | Phillips |
| 6,120,473 | A | 9/2000 | Oliverio |
| 6,122,901 | A | 9/2000 | Schultz |
| 6,129,963 | A | 10/2000 | Lesko |
| 6,146,324 | A | 11/2000 | Engel |
| 6,153,279 | A | 11/2000 | Charley |
| 6,162,457 | A | 12/2000 | Martz |
| 6,183,340 | B1 | 2/2001 | Wen |
| 6,233,747 | B1 | 5/2001 | Barker |
| 6,244,177 | B1 | 6/2001 | Young |
| 6,245,959 | B1 | 6/2001 | Ohira |
| 6,254,582 | B1 | 7/2001 | O'Donnell |
| 6,255,553 | B1 | 7/2001 | Sullivan |
| D446,913 | S | 8/2001 | Holden |
| 6,270,872 | B1 | 8/2001 | Cline |
| 6,286,872 | B2 | 9/2001 | Barre |
| 6,299,586 | B1 | 10/2001 | Cao |
| 6,316,073 | B1 | 11/2001 | Hiscock |
| 6,334,443 | B1 | 1/2002 | Olsen |
| 6,338,665 | B1 | 1/2002 | Dawson et al. |
| 6,347,405 | B1 | 2/2002 | Boyko |
| 6,350,338 | B1 | 2/2002 | Comiskey et al. |
| 6,362,387 | B1 | 3/2002 | Carlson |
| D455,002 | S | 4/2002 | Holden |
| 6,371,831 | B1 | 4/2002 | Dodge |
| 6,397,391 | B2 | 6/2002 | DeMarco |
| 6,397,398 | B1 | 6/2002 | Herder |
| 6,402,211 | B1 | 6/2002 | Chapman |
| 6,440,526 | B1 | 8/2002 | Gamble |
| 6,441,092 | B1 | 8/2002 | Gieselman |
| 6,442,869 | B2 | 9/2002 | Coomes |
| 6,446,268 | B1 | 9/2002 | Lazarian |
| 6,460,191 | B1 | 10/2002 | Lorkovic |
| 6,464,658 | B1 | 10/2002 | Darcey |
| 6,475,585 | B1 | 11/2002 | Yamanashi et al. |
| 6,475,587 | B1 | 11/2002 | O'Neill |
| 6,495,229 | B1 | 12/2002 | Carte et al. |
| 6,495,230 | B1 | 12/2002 | Canto |
| 6,497,949 | B1 | 12/2002 | Hyde et al. |
| 6,503,591 | B2 | 1/2003 | Kuo et al. |
| 6,513,925 | B1 | 2/2003 | Bonacci |
| 6,514,606 | B2 | 2/2003 | Kinoshita |
| 6,521,309 | B1 | 2/2003 | Chen et al. |
| 6,568,574 | B2 | 5/2003 | Jones et al. |
| 6,574,801 | B1 | 6/2003 | Harens et al. |
| 6,586,071 | B1 | 7/2003 | Hanes |
| 6,586,651 | B2 | 7/2003 | Sullivan |
| 6,610,897 | B2 | 8/2003 | Cavanagh et al. |
| RE38,246 | E | 9/2003 | Leonard |
| 6,613,382 | B1 | 9/2003 | Lee |
| 6,640,465 | B1 | 11/2003 | Burgess |
| 6,684,442 | B1 | 2/2004 | Parker et al. |
| 6,767,265 | B2 | 7/2004 | Gamble et al. |
| 6,793,999 | B2 | 9/2004 | Wittmeyer |
| 6,805,961 | B1 | 10/2004 | Watanabe et al. |
| 6,814,648 | B2 | 11/2004 | Chong |
| 6,857,935 | B1 | 2/2005 | Dohan |
| 6,878,034 | B1 | 4/2005 | Cisneros |
| 6,916,224 | B2 | 7/2005 | Chen et al. |
| 6,967,046 | B2 | 11/2005 | Bollinger |
| D516,802 | S | 3/2006 | Johnson |
| 7,029,552 | B1 | 4/2006 | Bruckner |
| 7,122,236 | B2 | 10/2006 | Mitchell et al. |
| D537,610 | S | 3/2007 | Escamillo |
| 7,399,216 | B2 | 7/2008 | Mateo |
| D583,103 | S | 12/2008 | Holden |
| 7,585,200 | B1 | 9/2009 | McLaren |
| D605,816 | S | 12/2009 | Holden |
| D625,101 | S | 10/2010 | Holden |
| 8,032,951 | B1 | 10/2011 | Nestberg |
| 2001/0017141 | A1 | 8/2001 | Gueret |
| 2001/0027079 | A1 | 10/2001 | Valentin |
| 2002/0004996 | A1 | 1/2002 | Scheucher |
| 2002/0013565 | A1 | 1/2002 | Cinelli et al. |
| 2002/0138896 | A1 | 10/2002 | Holden |
| 2003/0034368 | A1 | 2/2003 | Brzyski |
| 2003/0057240 | A1 | 3/2003 | Johnson |
| 2003/0127181 | A1 | 7/2003 | Kreckel |
| 2003/0136410 | A1 | 7/2003 | Matich |
| 2003/0161983 | A1 | 8/2003 | Rousselet |
| 2003/0172430 | A1 | 9/2003 | Jarrett |
| 2003/0184081 | A1 | 10/2003 | Carlson, II |
| 2003/0228436 | A1 | 12/2003 | Ishimura |
| 2004/0006814 | A1 | 1/2004 | Holden |
| 2004/0031723 | A1 | 2/2004 | Jean-Louis |
| 2004/0033325 | A1 | 2/2004 | Shea |
| 2004/0237165 | A1 | 12/2004 | Holden |
| 2004/0237166 | A1 | 12/2004 | Holden |
| 2004/0258457 | A1 | 12/2004 | Legendre |
| 2005/0011084 | A1 | 1/2005 | Stephenson |
| 2005/0037689 | A1 | 2/2005 | Gorski |
| 2005/0133130 | A1 | 6/2005 | Blum et al. |
| 2005/0160520 | A1 | 7/2005 | Forrest |
| 2005/0188450 | A1 | 9/2005 | Clark |
| 2005/0193476 | A1 | 9/2005 | Chinn |
| 2005/0193479 | A1 | 9/2005 | Atta et al. |
| 2005/0193609 | A1 | 9/2005 | Schwartz |
| 2005/0233662 | A1 | 10/2005 | Kimbrell |
| 2005/0282024 | A1 | 12/2005 | Sherman et al. |
| 2006/0216523 | A1 | 9/2006 | Takaki |
| 2006/0230499 | A1 | 10/2006 | Davis |
| 2007/0054081 | A1 | 3/2007 | DeMarco |
| 2007/0087042 | A1 | 4/2007 | Thomas |
| 2007/0090007 | A1* | 4/2007 | Ames ..... 206/320 |
| 2007/0124850 | A1 | 6/2007 | Buettner |
| 2007/0254129 | A1 | 11/2007 | Horblitt |
| 2008/0066212 | A1 | 3/2008 | Holden |
| 2008/0127397 | A1 | 6/2008 | Toyne |
| 2008/0140194 | A1 | 6/2008 | Hansen |
| 2009/0158502 | A1 | 6/2009 | Medolla |
| 2010/0044249 | A1 | 2/2010 | Holden |
| 2010/0083422 | A1 | 4/2010 | Lebl |
| 2011/0147428 | A1* | 6/2011 | Crawford et al. ..... 224/245 |
| 2011/0185477 | A1 | 8/2011 | Olenicoff |

FOREIGN PATENT DOCUMENTS

| | | |
|---|---|---|
| GB | 28382761 | 11/2003 |
| WO | WO9011191 A1 | 10/1990 |
| WO | WO9820760 A1 | 5/1998 |

OTHER PUBLICATIONS

Photographs of Bodpockets "The Pocket Your Wear" Faux Leather Bodpocket-Black; including invoice of product purchase dated Nov. 30, 2011, 10 pages.

Kevin's Blog Testing and Recommendations; Aug. 2, 2011, 13 pages.

Press Release, Arizond Inventor to Exhibit 'Bodpockets', 'Footpadz,' and 'Handpadz' at America's Largest Invention Show, Inpex Invention and New Product Exposition, Pittsburgh, PA, Jun. 11, 2008.

Web printouts and web archive printouts from the website www.bodpocketstore.com, Dec. 2, 2011, 13 pages.

Web printouts and web archive printouts from the website www.bodpockets.com, Dec. 2, 2011, 3 pages.

* cited by examiner

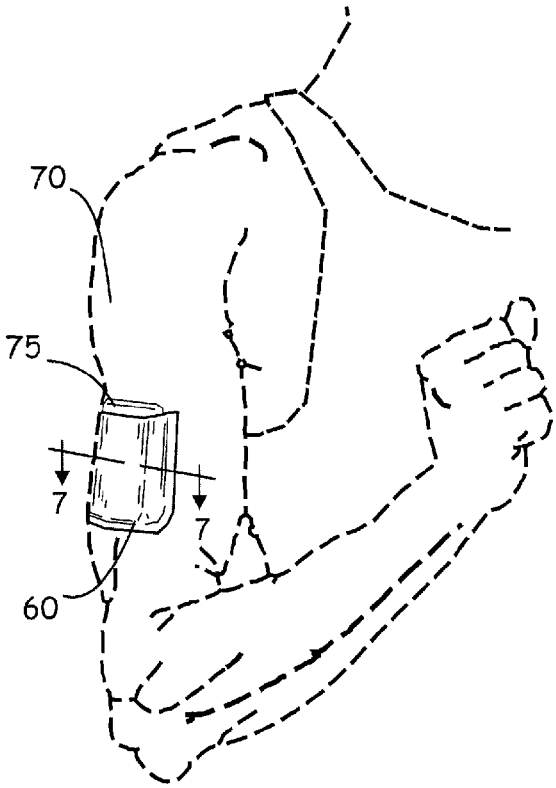
FIG. 6.
FIG. 7.
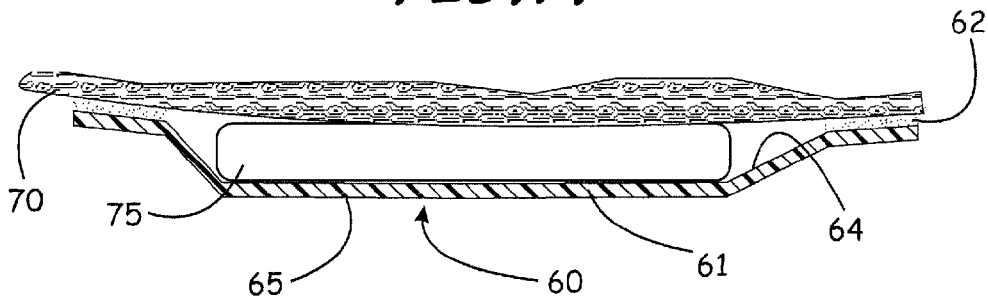

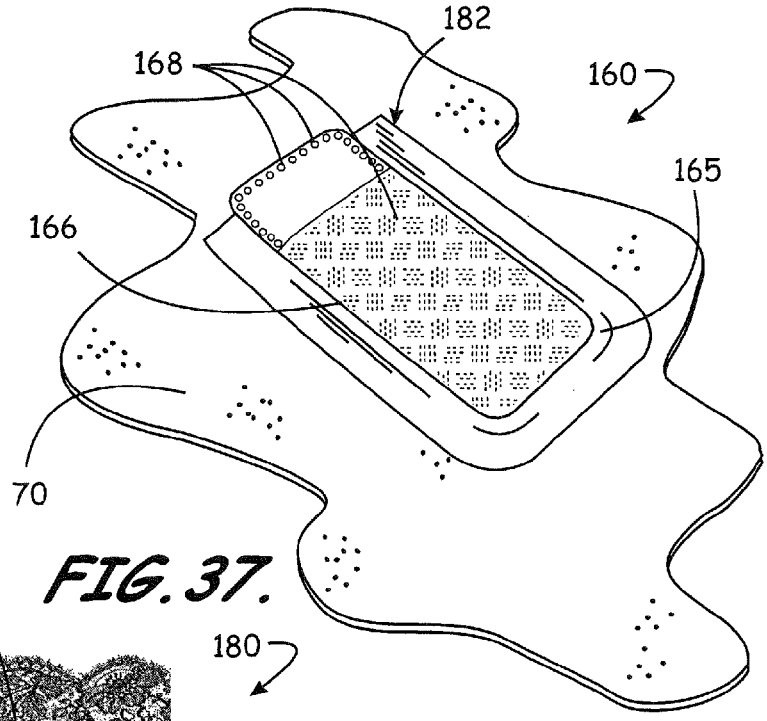
FIG. 37.
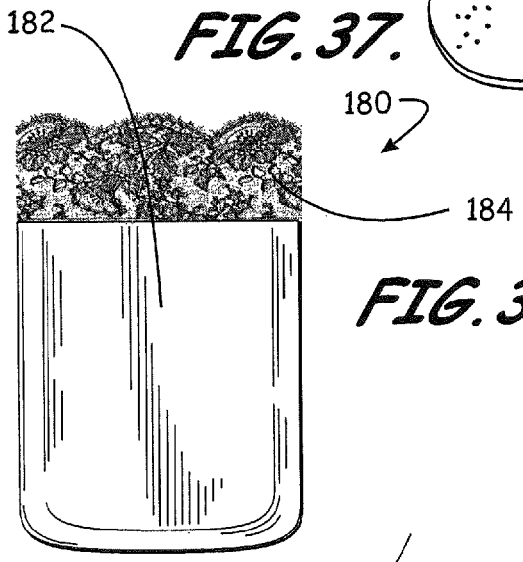
FIG. 38.
FIG. 39.
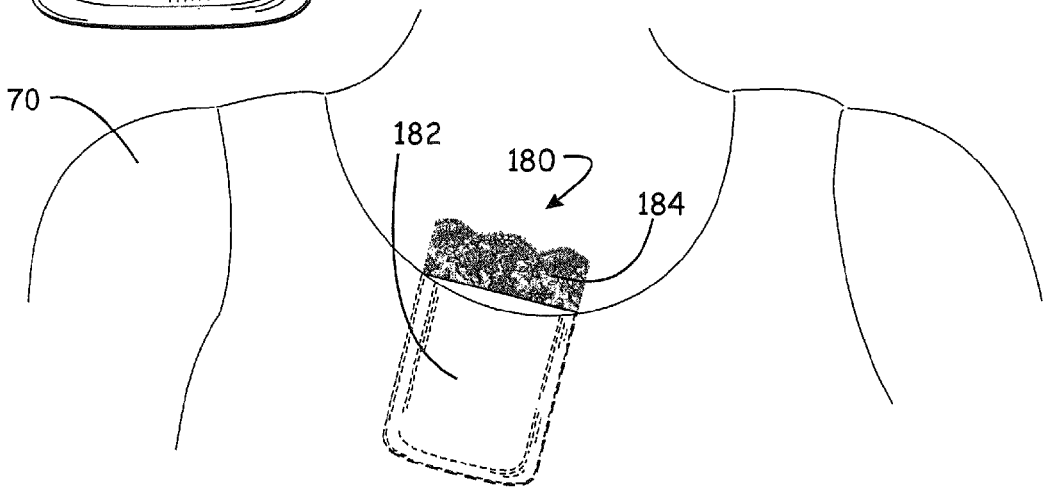

KIT OF A PLURALITY OF DETACHABLE POCKETS, A DETACHABLE POCKET, AND ASSOCIATED METHODS

RELATED APPLICATIONS

The present application relates to, claims benefit of, and claims priority to U.S. Provisional Patent Application Ser. No. 61/566,423 titled "Kit of a Plurality of Detachable Pockets, A Detachable Pocket, and Associated Methods" and which is incorporated herein by reference in its entirety.

BACKGROUND

1. Field of the Invention

Embodiments of the present invention relates to the disposable product industries and, more particularly, detachable pockets that can be readily disposed.

2. Related Art

Pockets on clothing have been known for decades and perhaps even hundreds of years. It also has been known to make such pockets fixed to clothing or readily attachable to clothing using a variety of techniques. More often, however, pockets once attached have been difficult to remove from clothing as it has been important for such pockets not to slip on the clothing material once attached and for the clothing to be readily washable with the pocket when added, e.g., to be more of a permanent addition to the clothing such as by stitching the pocket to the clothing.

SUMMARY OF THE INVENTION

In view of the foregoing, Applicants recognized that many types of clothing have no readily accessible location for a pocket, make having a pocket in a prominent location awkward, unsightly, or not otherwise providing as much style to the clothing. As a result, a person wearing various types of clothing can find themselves in locations with money, cell phones, credit, identification, or other types of cards, or other items, including personal items, and having no place on their person to readily store the items. This not only can be inconvenient but can be riskier to the person in some situations. Applicants also recognized that existing attachable pockets are not readily designed or constructed to attach to a person's skin.

Applicants further recognized that in many situations a person desires an option to attach a pocket to clothing or their skin in a location of which the wearer gets to choose, desires to wear the same piece of clothing at times with a pocket and at times without a pocket, and desires to be able to readily remove a pocket to allow washing of the clothing without the pocket. Applicants also still recognized that a wearer can desire to attach such a pocket on inner surfaces of clothing or on outer surfaces of a wearer's skin to keep a pocket and the personal items therein hidden from others view or otherwise concealed. Additionally still, Applicants recognized that it can be desirable to dispose of or throw away a pocket after one or a few uses as the pocket may be soiled, not have the same texture, feel, resiliency, or not have the same holding strength for items.

Further still, Applicants recognized that is can be desirable to have pockets shaped and sized for particular commonly shaped and sized personal items such as a cell phone, personal digital assistant, smart phone, credit card, money or other specifically shaped items and to have a choice or selection of what type of pocket to use in various situations that can be readily detached once attached and readily dispose of thereafter if desired. Applicants also recognized that having decorative materials, such as lace, sparkles, patterns, or the like, attached to such detachable, as well as disposable, pockets allows a wearer to add style to clothing or appearance if the wearer desires that the pocket itself or decorative material to be viewable by others such as when positioned to underlie clothing or other arrangements.

Embodiments of the invention include to a kit of a plurality of detachable pockets, a detachable pocket and associated methods. In an embodiment, the kit has a container, such as a box, carton, pouch, or bag, with a plurality of disposable and detachable pockets positioned therein. Each disposable and detachable pocket within the container, for example, also can be individually wrapped or packaged if desired such as being encased in a plastic, paper or other materials. Each detachable pocket can be used, for example, to hold personal items on a person's clothing or skin, such as the interior of a swimsuit, bra, shirt, jacket, or the like, when attached. Each detachable pocket provided in the kit, in some embodiments, is capable of being adhered to a person's clothing or skin using the adhesive already present on the detachable pocket and may be used to provide a place to hold a money, credit, identification, or other types of cards, cell phone, keys, wallet, or other items when the person does not have pockets available or does not have enough pockets to hold all personal items. In some embodiments the kit can also include other items to assist with the disposable pocket attachment or removal such as a cleaning cloth to clean skin or clothing before attachment or after detachment.

An embodiment of a detachable pocket, for example, can have a pocket body portion that includes a pocket layer and a flange. Both the pocket layer and the flange can be fabricated from one or more fabrics or materials such as plastic, nylon, neoprene or the like, as well as various combinations of fabrics or materials. In some embodiments, for example, the pocket layer can be substantially rectangular, have an end to be attached as open and defining an open end and three sides having the flange disposed there around along and to which adhesive is disposed. In other embodiments, for example, the pocket layer can have a polygon shape and have a concave medial portion thereof, with a flange extending around four sides so that the flange can be abuttingly disposed on the person's clothing article or skin to thereby create a pocket by allowing access through an open side or end of the flange where no adhesive resides.

In other embodiments, for example, the pocket body can be fashioned as a closable pocket, with an upper layer, a lower layer, and a flange. For such a pocket body, the upper layer can be generally rectangular with a portion of a sealing member, e.g., button, snap, hook-loop fastener, elastic or the like, disposed on a top side thereof. The lower layer can be generally rectangular, for example, with three side edges of the upper layer adhered on the top side of same. A flap portion has the other portion of a sealing member, e.g., button, snap, hook-loop fastener, elastic or the like, disposed thereon and extending from the edge side of the lower layer not adhered to the upper layer over the top side of the upper layer so that the pocket body forms a pocket capable of being closed. In such embodiments, for example, the flange may be disposed along four rectangular side edges of the bottom side of the lower layer to support additional layers of the pocket body. In some embodiments, the flange can include wire, plastic, stiff fabric or shaped fabric so that the pocket body maintains a particular shape when attached to clothing. To attach the flange to the persons clothing article or skin, in some embodiments, the flange can have disposed on a portion parallel to the pocket layer, an adhesive layer covered by a removable non-stick backing. In other embodiments, the pocket body can be attached to the clothing article using a two-sided adhesive strip having the same general shape as the flange, or other configurations suitable for pocket operation as understood by those skilled in the art.

In use, in some embodiments for example, a person can remove a detachable pocket from the kit, remove a wrapper or other packaging from the detachable pocket, and position the pocket on the interior of an article of clothing. Once the pocket is arranged in a set user-selected position in such embodiments, the person may remove the non-stick backing on the adhesive layer to adhere the flange of the pocket having adhesive thereon to the clothing article. In other embodiments, for example, the person can remove a two-sided adhesive strip from the kit, remove the non-stick backing on one side of the adhesive strip, and place the adhesive strip in the desired position on the article of clothing. Once the adhesive is in place, in such an embodiment, a non-stick backing on the opposing side of the adhesive strip can be removed, and the flange of the pocket body adhered to the adhesive strip and clothing. In such embodiments, only one detachable pocket and multiple reusable adhesive strips can be provided in the kit. To remove the pocket from the clothing, in some embodiments, the person can use force, i.e., pulling the pocket from the clothing or skin, or a solvent such as mineral oil or the like. In some embodiments, the pocket is disposed of or thrown away, e.g., single use, if desired.

Embodiments of methods of attaching, removing, wearing, and using a detachable pocket are also provided. A method of attaching a detachable pocket, for example, includes removing a detachable pocket from a kit, removing packaging from the detachable pocket, positioning the pocket on a surface, and applying pressure to the detachable pocket. The method can also include removing non-stick backing on an adhesive layer to adhere a flange or other portion of the detachable pocket having adhesive thereon to the surface. The detachable pocket, in an embodiment, can have a pocket body preferably formed of a unitary material substantially throughout, as will be understood by those skilled in the art, and having adhesive on a surface thereof so that two or more, and preferably three or more, side edges contact the surface, e.g., skin or clothing, and one side edge portion remains open to define an open end. The method further can include inserting one or more items into the pocket through the open end. Further, an example of attaching such a pocket can be to an inner surface of clothing that faces or is to face a wearers body when positioned thereon, such as illustrated, and also can be on a skin of a wearer so that clothing covers or obfuscates all or significant portions of the detachable pocket. Some types of clothing, such as t-shirts, undergarments, swimsuits, and blouses, can allow designs or other indicia, as well as lace or other add-ons and additions to the pocket to be seen or viewed by a wearer or others through the clothing or in peripheral portions of the clothing.

BRIEF DESCRIPTION OF DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

FIG. 6 is a perspective view of a pocket positioned on an arm of a user as illustrated in dashed lines according to an embodiment of a pocket of the present invention;

FIG. 7 is a sectional view taken along line 7-7 of the pocket of FIG. 6 according to an embodiment of a pocket of the present invention;

FIG. 37 is an environmental perspective view of a disposable pocket adhered to the person's skin according to yet an additional embodiment of the present invention;

FIG. 38 is a perspective view of a disposable pocket according to further yet another embodiment of the present invention; and FIG. 39 is an environmental perspective view of a disposable pocket of FIG. 38 positioned on a wearer according to an embodiment of the present invention.

DETAILED DESCRIPTION

The present invention will now be described more fully hereinafter with reference to the accompanying drawings, which illustrate various embodiments of the invention. This invention, however, may be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Applicants recognized a need for a kit of detachable pockets and detachable pockets that can be used by a person to readily attach a pocket to a person's skin or an article of clothing. The detachable pocket, for example, allows a person to hold various types of items, such as money, cell phones, credit, identification, or other types of cards. A person can have the option to attach a pocket to clothing or their skin, to wear the same piece of clothing at times with a pocket and at times without a pocket, and to be able to readily remove a pocket to allow washing of the clothing without the pocket. As will be understood by those skilled in the art, in some embodiments, for example, a disposable pocket preferably is made of material often thrown away after initial use such as with common adhesive strips. Such disposable pockets are preferable readily detachable from clothing or skin once attached so that little to no damage to clothing or skin occurs during removal or the rick of damage to the clothing or skin is greatly reduced as compared to stitching or sewing a pocket or garments.

Figure 1:
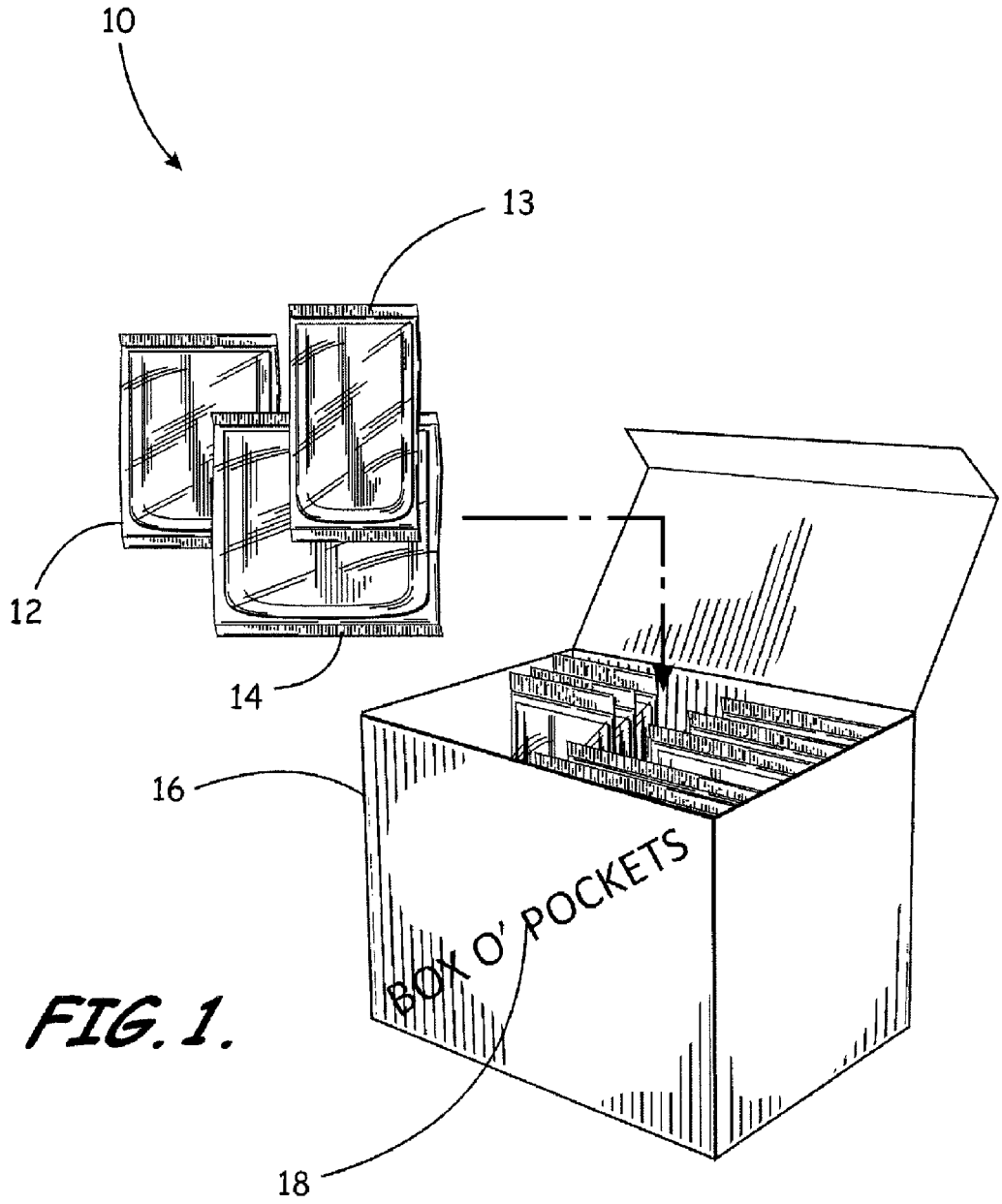
FIG. 1 is an exploded perspective view of a kit of pockets according to an embodiment of a kit of the present invention.

As shown in FIG. 1, according to an embodiment of the present invention, an example of a kit 10 of a plurality of detachable pockets can include a plurality of disposable and detachable pockets, e.g., pockets 12, 13, and 14, positioned within a container 16. The plurality of detachable pockets 12, 13, 14, in this embodiment can have varying sizes and shapes and can be loosely arranged within the container 16. The container 16 can be a box, carton, pouch, or bag. According to this embodiment, the container can have indicia or label 18 for identification if desired such as "BOX O' POCKETS", for example. The container 16 can have a flap or cover for opening and closing top end of the container 16. When open, the open top end of the container 16 allows access for organizing the disposable and detachable pockets 12, 13, 14, within the container 16. The kit 10 can also include other items to assist with the attachment or removal of the pockets 12, 13, 14. Such items can include a cleaning cloth to clean skin 70 or clothing before attachment or after detachment. The kit 10 can be refilled with additional detachable pockets 12, 13, 14 as they are used.

Figure 2:
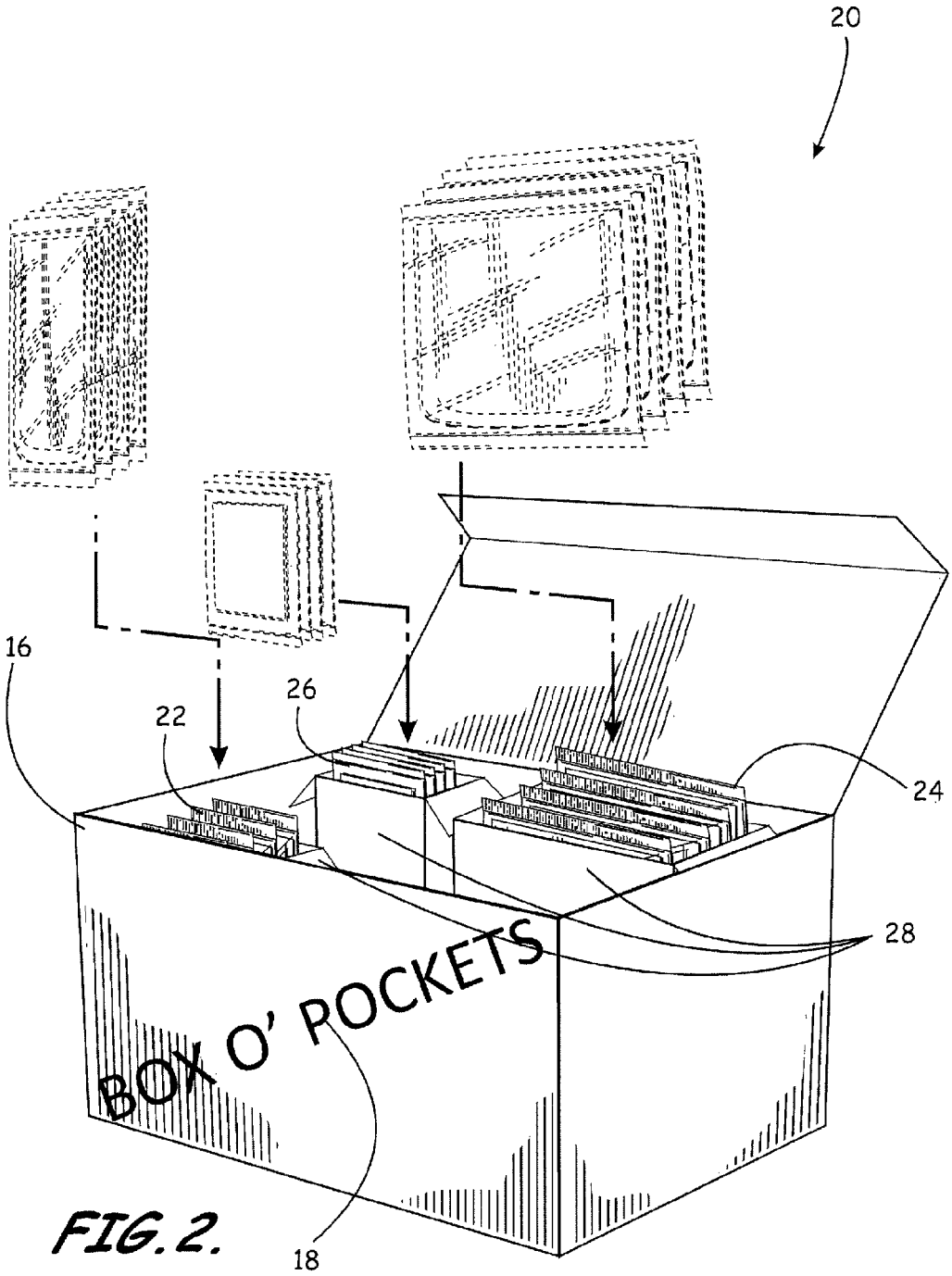
FIG. 2 is an exploded perspective view of a kit of pockets according to another embodiment of a kit of the present invention.

In some embodiments of a kit, each disposable and detachable pocket 12, 13, 14 within the container 16, for example, can be individually wrapped or packaged so as to be encased by plastic, paper, combinations thereof, or other suitable packaging materials as understood by those skilled in the art. The pockets can be used, for example, to hold personal items on a person's clothing or skin, such as the interior of a swimsuit, bra, shirt, jacket, or the like. In embodiments of a kit as illustrated and described herein one or more of the plurality of detachable pockets 22, 24, 26 positioned within the container has a first size and shape different than a second size and shape of one of more of the plurality of detachable pockets positioned within the container. Each of the first size and shape and the second size and shape substantially correspond to a size and shape of one or more of the following items: a cell phone, a personal digital assistant, a smart phone, money, folded money, credit card, debit card, identification card, a container of liquid, powder, lotion, or gel, and so that a first personal item readily inserts into the detachable pocket having the first size and shape and a second personal item readily inserts in the detachable pocket having the second size and shape In an alternate embodiment, a kit 20 includes a plurality of disposable and detachable pockets 22, 24, 26 that can be positioned within a plurality of receptacles or sub-containers 28 located within the container 16 (see FIG. 2). The receptacles 28 can be of varying sizes and shapes corresponding to same of the pockets 22, 24, 26. The receptacles 28 allow a user of the kit 20 to readily identify the type of pocket 22, 24, and 26 desired. In this embodiment, the plurality of rectangular sub-containers 28 have an open end that receives the disposable and detachable pockets 22, 24, 26 to organize the pockets as desired.

Figure 3:
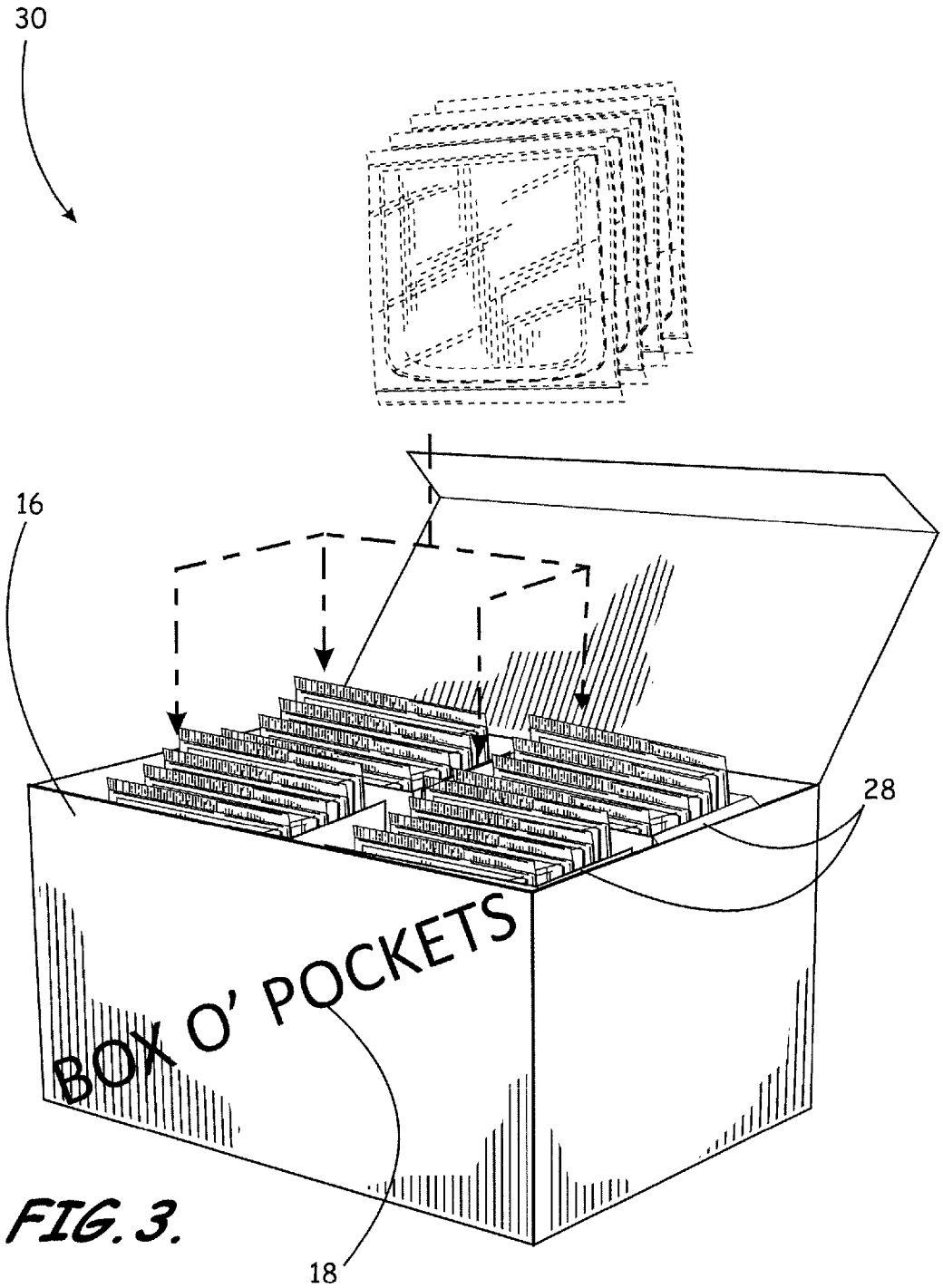
FIG. 3 is an exploded perspective view of a kit of pockets according to yet another embodiment of a kit of the present invention.

In another alternate embodiment, a kit 30 includes a plurality of disposable and detachable pockets that can be positioned within the plurality of receptacles or sub-containers 28 located within the container 16 (see FIG. 3). The receptacles 28, in this embodiment, can be the same size and shape corresponding to same of the pockets. For example, if a user of the kit 30 desires a plurality of only one type of pocket.

Figure 4:
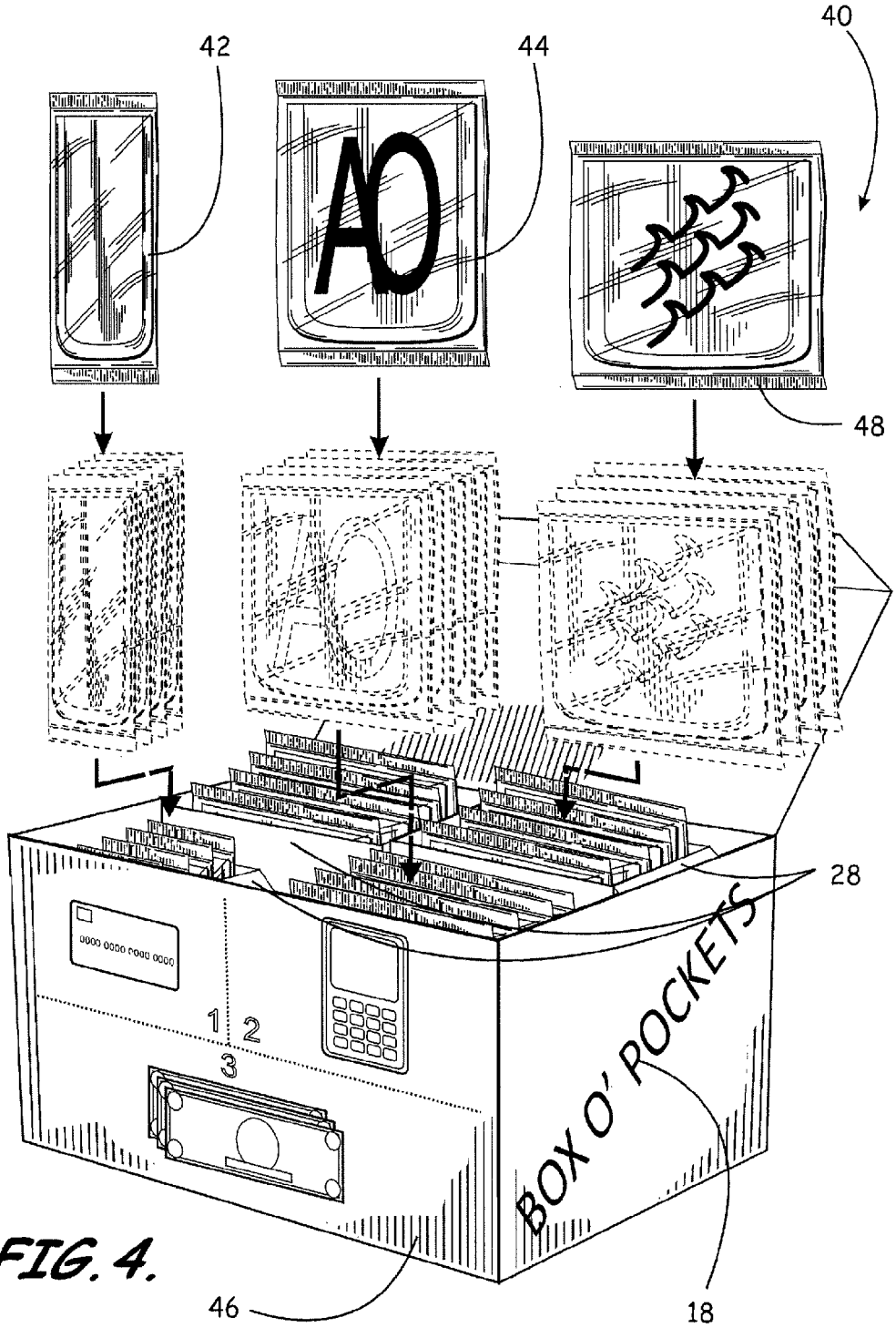
FIG. 4 is an exploded perspective view of a kit of pockets according to still another embodiment of a kit of the present invention.

In still another alternate embodiment, a kit 40 includes a plurality of disposable and detachable pockets 42, 44, and 48 that can be positioned within the plurality of receptacles or sub-containers 28 located within the container 16 (see FIG. 4). The detachable pockets 42, 44, and 48 can be plain, or contain indicia, such as emblems or patterns, as shown. Indicia can be visible through clothing to a wearer or third person if desired (see, e.g., FIGS. 29 and 33A-34). The receptacles 28 can be of varying sizes and shapes adapted specifically for types of items such as credit, debit or gift cards, cash, or cell phones, personal digital assistants, smart phones, digital music players, or the like, and corresponding to same of the pockets 42, 44, and 48. The receptacles 28 allow a user of the kit 40 to readily identify the type of pocket 42, 44, and 48 desired. In this embodiment, the container 16 can have a patterned or decorative outer surface 46.

Figure 5:
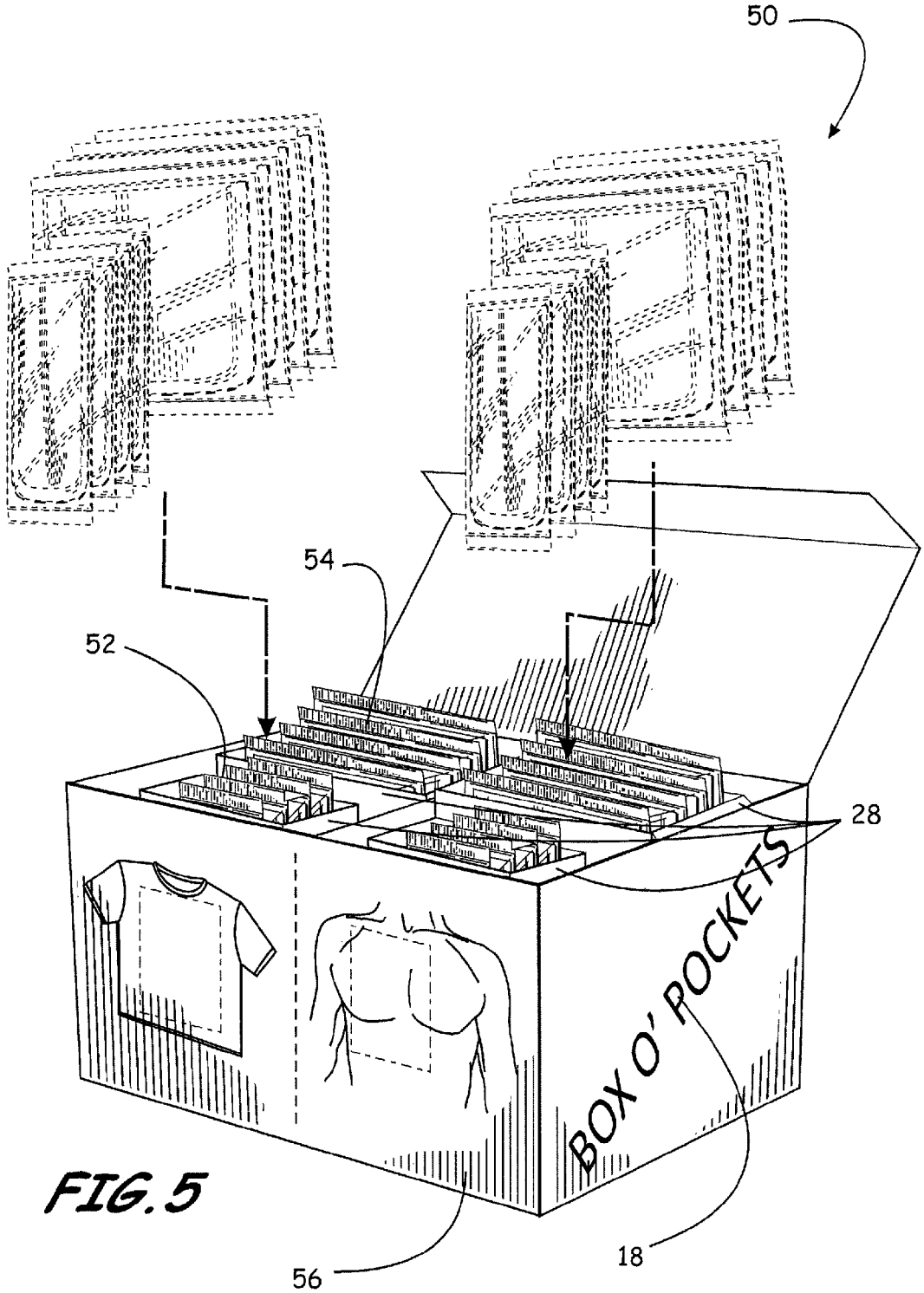
FIG. 5 is an exploded perspective view of a kit of pockets according to still yet another embodiment of a kit of the present invention.

In yet another alternate embodiment, a kit 50 includes a plurality of disposable and detachable pockets 52, 54 that can be positioned within the plurality of receptacles or sub-containers 28 located within the container 16 (see FIG. 5). The receptacles 28 can be of varying sizes and shapes corresponding to same of the pockets 52, 54. The receptacles 28 allow a user of the kit 50 to readily identify the type of pocket 52, 54 is desired. In this embodiment, the pockets 52, 54 are further arranged into two rows within the container 16. One row can be designated for adherence to a person's skin and the other row can be designated for adherence to a clothing article. In this example, the designation can be via an illustration on a front outer surface 56 of the container showing a human torso for adherence to skin and a shirt for adherence to a clothing article.

According to embodiments of the present invention a detachable pocket 60 can be provided in each of the kits 10, 20, 30, 40, and 50 discussed above (see, e.g., FIGS. 1-5). In these embodiments, the detachable pocket 60 has an outer surface 64 and has a generally rectangular shape (see, e.g., FIGS. 6-7 and 19-20). The pocket 60 is capable of being adhered to a person's skin 70, such as an upper arm, using an adhesive 62 already present on the detachable pocket 60. In this embodiment, the adhesive 62 can be present along three edges or side portions, a flange or other portions of a unitary pocket layer 61 of the pocket 60. The adhesive 62, as will be understood by those skilled in the art, can be moisture resistant so perspiration or water does not cause the pocket 60 readily to fall off or detach until a user desired to readily detach the pocket such as like detaching an adhesive strip. An outwardly displaced portion or pocket body 65 provides a space or cavity in the pocket 60 being bounded by a surface of a portion of clothing fabric and a surface of the packet body or a portion of a wearer's skin and surface at the pocket body that it can be used to hold an item 75. The pocket body 65 allows the item to be held against a person's skin 70 or surface of an article of clothing. The items can include money, credit, identification, or other types of cards, cell phone, keys, wallet, or other items when the person does not have pockets available or does not have enough pockets to hold all personal items. Pockets 60 can be fabricated from at least one or a combination of materials including a plastic, nylon, neoprene, or the like, as well as other fabrics and combinations of materials. In an alternate embodiment, the disposable pocket 60 can also be adhered to skin on other parts of a person's body, such as a leg.

Figure 8:
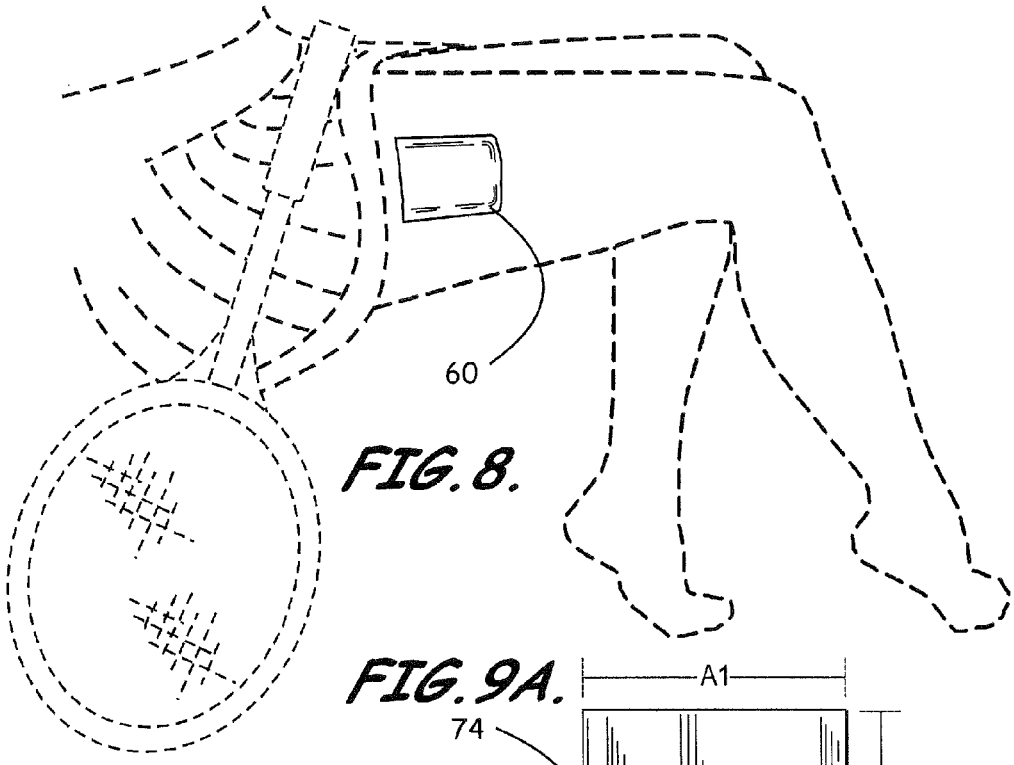
FIG. 8 is a perspective view of a pocket positioned on a leg of a user according to another embodiment of a pocket of the present invention.
Figure 9A:
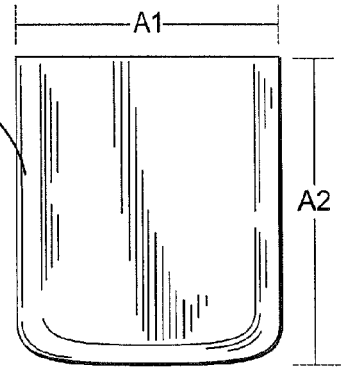
FIGS. 9A-9C are front plan views of various sized pockets according to additional embodiments of pockets of the present invention.
Figure 9B:
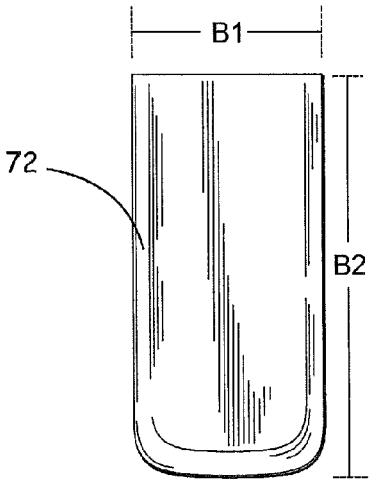
Figure 9C:
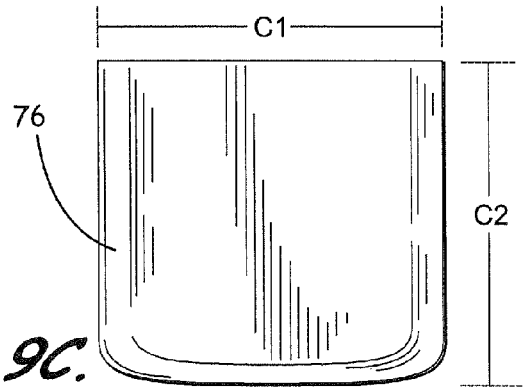
Figure 10:
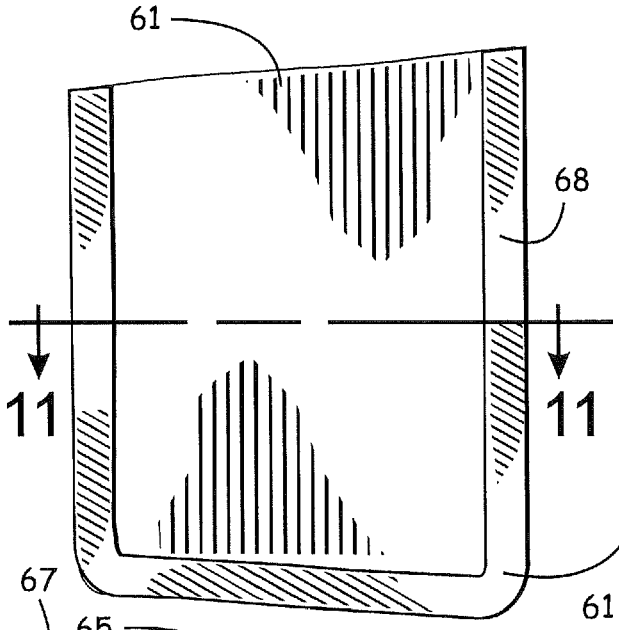
FIG. 10 is a perspective rear view of a pocket according to an embodiment of a pocket of the present invention.
Figure 11:
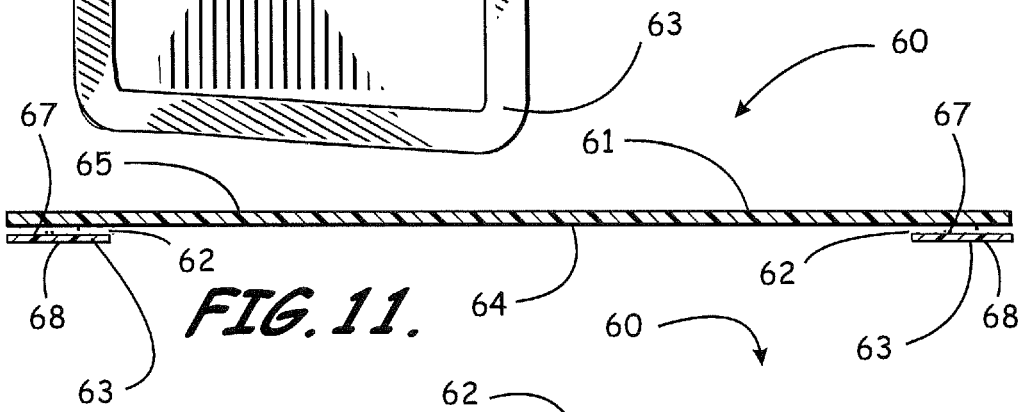
FIG. 11 is a sectional view taken along line 11-11 of the pocket of FIG. 10 according to an embodiment of the present invention.
Figure 12:
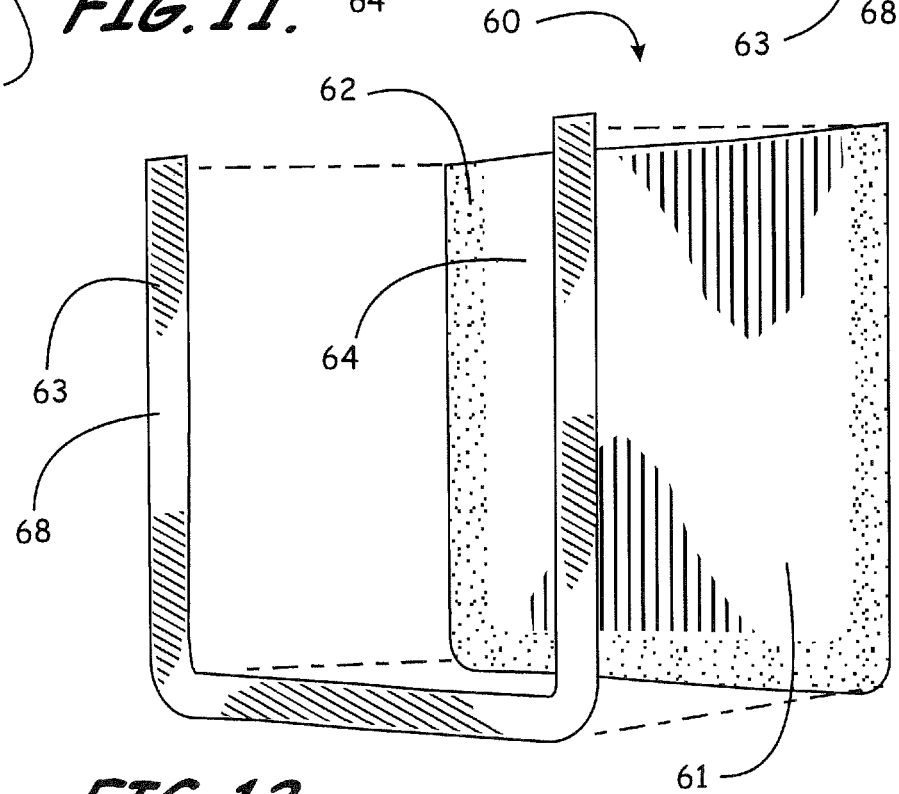
FIG. 12 is an exploded perspective view of the pocket of FIG. 10 according to an embodiment of a pocket of the present invention.

In an alternate embodiment, a kit 10, 20, 30, 40, or 50, can include a plurality of detachable pockets 72, 74, and 76 having varying shapes and sizes, allowing a user to choose the detachable pocket 72, 74, or 76 desired (see, e.g., FIGS. 8-9C). Each of the plurality of detachable pockets 72, 74, and 76 can also be disposable, as previously discussed. In an embodiment, for example, the detachable pocket 72 has a length B2 that is relatively longer than a width B1 of the pocket 72. The detachable pocket 72 has three edge portions that can adhere to a surface when applied. Alternatively, a backside of the detachable pocket 72 can have an adhesive coating to increase adherence to a surface. The detachable pocket 72 has a generally rectangular shape with an open end for allowing items to be held within the detachable pocket 72. A closed end is formed on the detachable pocket 72 substantially opposite the open end of the detachable pocket 72. The closed end of the detachable pocket 72 for example, can have rounded edges. Edge portions of the detachable pocket can also be substantially straight or have angular or other forms.

For example, perhaps as best shown in FIGS. 8-9C, embodiments of a detachable pocket 74 can have a length A2 that is relatively the same as a width A1 of the pocket 74. The detachable pocket 74 has three edge portions that can adhere to a surface 70 when applied. Alternatively, a backside of the detachable pocket 72 can have an adhesive coating to increase adherence to a surface. The detachable pocket 74 has a generally rectangular shape with an open end for allowing items to be held within the detachable pocket 74. A closed end is formed on the detachable pocket 74 opposite the open end of the detachable pocket 74. The closed end of the detachable pocket 74 can have rounded edge portions. In this embodiment, for example, detachable pocket 74 can hold wider items than those that can be held by the previously discussed embodiment of a detachable pocket 72.

An embodiment of a disposable pocket 76 is shown in FIG. 9C as being the largest of the three pockets 72, 74, 76 and has a length C2 that is relatively the same as a width C1 of the pocket 76. As with the previously embodiments of discussed pockets, 72 and 74, the detachable pocket 76 has three edge portions that can adhere to a surface when applied. Alternatively, a backside of the detachable pocket 76 can have an adhesive coating to increase adherence to a surface. The detachable pocket 76 has a generally rectangular shape with an open end for allowing items to be held within the detachable pocket 76. A closed end is formed on the detachable pocket 76 opposite the open end of the detachable pocket 76. The closed end of the detachable pocket 76 can have rounded edges. In this embodiment, detachable pocket 76 can hold wider items than those that can be held by the previously discussed detachable pockets 72 and 74.

In yet another alternate embodiment of a detachable pocket 60, the detachable pocket 60 has a unitary pocket layer 61 and a flange or edge portion 63 (see e.g., FIGS. 6-7 and 10-12). The flange 63 is generally U-shaped, and along one surface facing the pocket body 65, the flange 63 adheres to the pocket body 65 of the pocket 60 via the adhesive 62. The adhesive 62 is shown on three facing edges of an inner surface 64 of the pocket body 65. The adhesive 62, however, could also be present on outward facing surface 67 of the flange 63. Alternatively, the pocket layer 61 can have multiple layers as will be understood by those skilled in the art. In an embodiment, for example, the flange 63 can be a double-sided strip. To allow adherence to skin or clothing, an inward facing surface 68 of the flange can also have an adhesive present. An edge or end portion of the inner surface 64 of the detachable pocket 60 that has no adhesive defines an open end to allow entry of items to be held in the detachable pocket 60. Alternatively, both sides of the double-sided flange 63 can have adhesive to allow adherence to surfaces on either side. The detachable pocket 60 has a generally rectangular shape but may have other shapes as well, such as, for example, triangular or semi-circular. A closed end is formed on the detachable pocket 60 opposite the open end of the detachable pocket 60. The closed end of the detachable pocket 60, for example, can have rounded edges. An end of the flange 63 that correspond to the closed end of the detachable pocket 60 also can have rounded edges. In this embodiment, the adhesive 62 on the flange 63 is applied in a U-shape corresponding to the shape of the flange 63. Alternatively, a side of the flange 63 can adheringly mate with two or more edges of the unitary pocket layer 61 with the side of the flange 63 generally corresponding in shape with the two or more edges of the unitary pocket layer. The two or more edge portions of the unitary pocket layer 61 can have adhesive.

Figure 13:
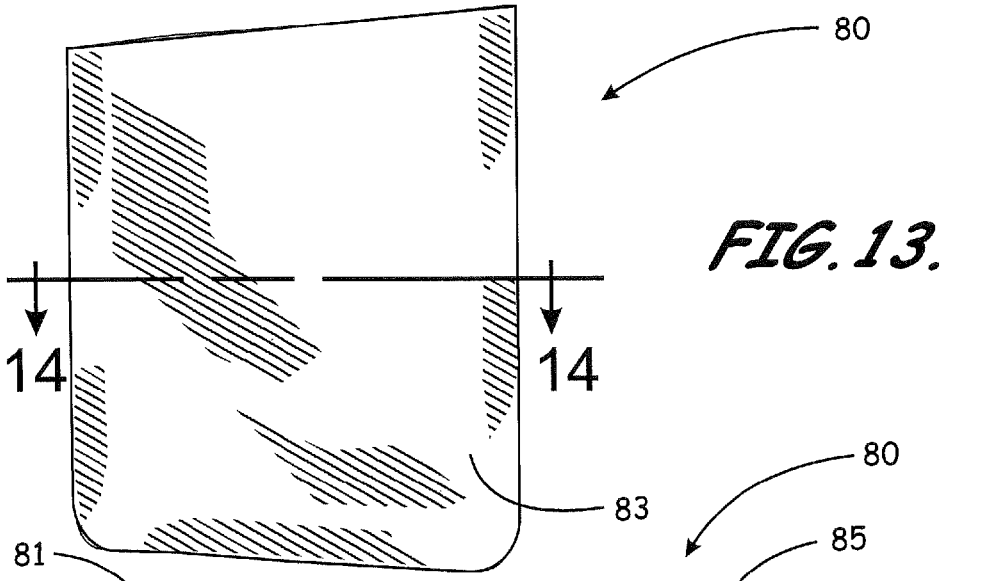
FIG. 13 is a rear perspective view of a pocket according to another embodiment of a pocket of the present invention.
Figure 14:
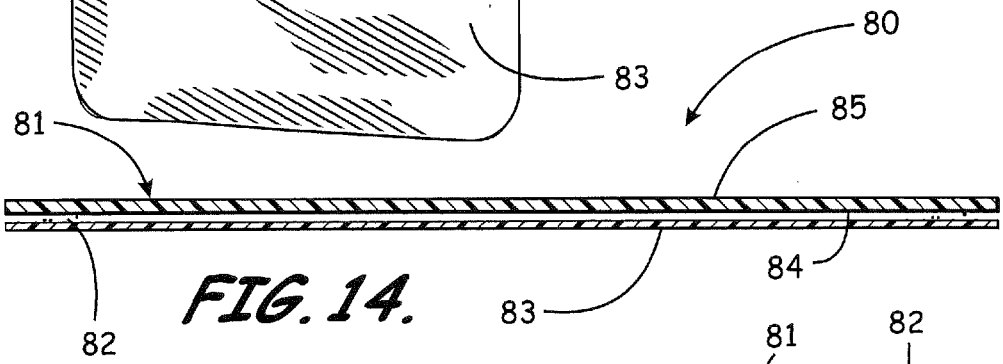
FIG. 14 is a sectional view taken along line 14-14 of the pocket of FIG. 13 according to another embodiment of a pocket of the present invention.
Figure 15:
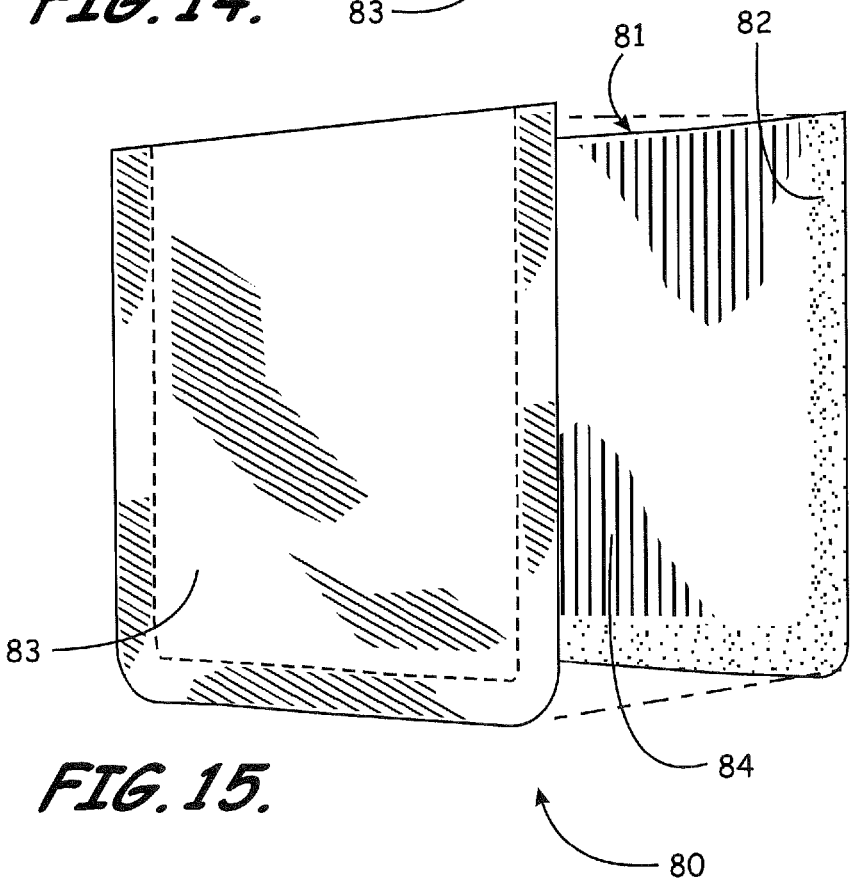
FIG. 15 is an exploded perspective view of the pocket of FIG. 13 according to another embodiment of a pocket of the present invention.

In an alternate embodiment, a detachable pocket 80 is shown in FIGS. 13-15 as having a unitary pocket layer 81 that is adhered to removable non-stick backing 83 via an adhesive 82 that is present on, three edge portions of an adhesive side 84 of the unitary pocket layer 81. The adhesive side 84 of the unitary pocket layer 81 can hold an item within pocket 80. An inward-facing surface 85 of the lower layer 81 can have adhesive present to allow adherence to human skin or an article of clothing, as explained in previous embodiments. An edge of the outward-facing surface 84 of the lower layer 81 that has no adhesive defines an open end to allow entry of items to be held in the detachable pocket 80. The detachable pocket 80 has a generally rectangular shape but may have other shapes as well, such as, for example, triangular or semi-circular. An edge of the unitary pocket layer 81 that has no adhesive defines an open end when applied to a surface to allow entry of items to be held in the pocket 80. A closed end is formed on the detachable pocket 80 opposite the open end of the detachable pocket 80. The closed end of the detachable pocket 80 can have round-shaped edge portions. An end of the non-stick backing 83 that correspond to the closed end of the detachable pocket 80 also can have round-shaped edge portions as shown. In this embodiment, the adhesive 82 on the edges of the unitary pocket layer 81 is applied in a U-shape corresponding to the shape made by the edge portions of the unitary pocket layer 81 on the adhesive side 84 of the detachable pocket 80. Alternatively, adhesive can be applied completely on the adhesive side 84 rather than only the edge portions.

Figure 16:
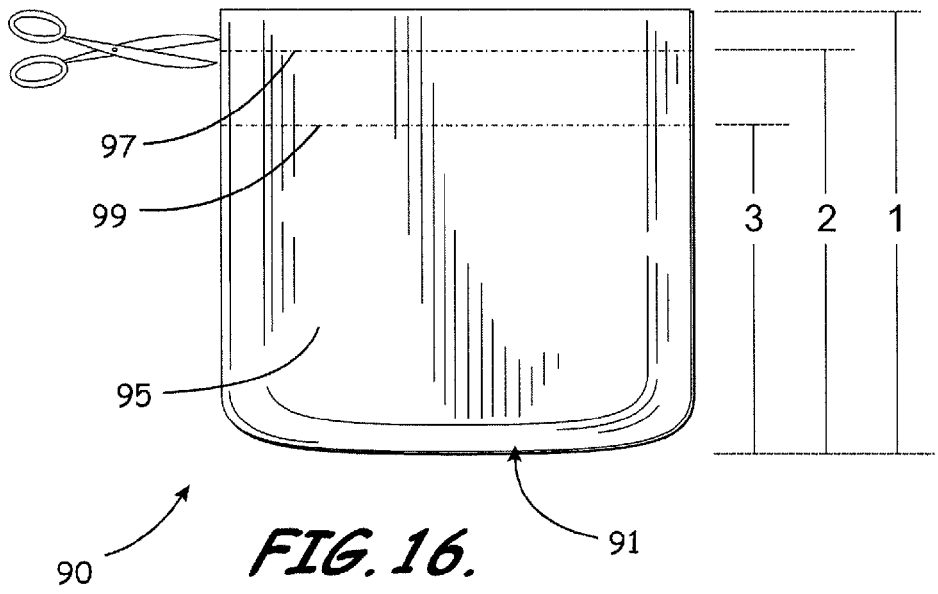
FIG. 16 is a front plan view of a pocket having cut, tear, perforation, or other sizing lines shown as dashed lines according to yet another embodiment of a pocket of the present invention.

In an alternate embodiment of a detachable pocket 90, the detachable pocket 90 has a flange or edge portion 91 that can adhere to human skin or an article of clothing (see FIG. 16). A unitary pocket layer 95 is formed within the detachable pocket 90 to define a pocket body that can hold items as discussed in previous embodiments. The flange 91 is generally U-shaped and defines an open end at top of pocket 90 to allow entry of items to be held in the pocket 90. In this embodiment, the pocket 90 can be used in its original size, for example, with a height "1" or can be cut along lines 97 or 99 to obtain heights "2" or "3", respectively, for the pocket 90 as shown. The lines 97, 99 can be perforated to facilitate cutting or tearing along the lines. An edge of unitary pocket layer 95 that has no adhesive defines an open end to allow entry of items to be held in the detachable pocket 90. The detachable pocket 90 has a generally rectangular shape but may have other shapes as well, such as, for example, triangular or semi-circular (see also FIGS. 17-18, for example). A closed end is formed on the detachable pocket 90 opposite the open end of the detachable pocket 90. The closed end of the detachable pocket 90 can have rounded edges. An end of the flange 91 that corresponds to the closed end of the detachable pocket 90, can have rounded edges. In this embodiment, adhesive can be present on the flange 91 or on a back side of the detachable pocket 90.

Figure 17:
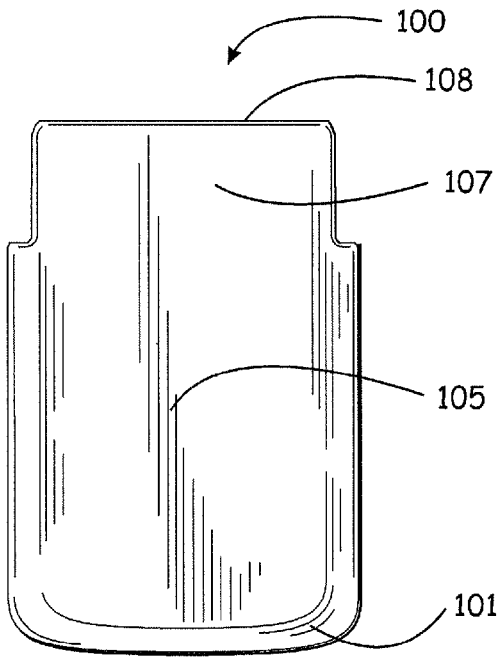
FIG. 17 is a front plan view of a pocket according to a further embodiment of a pocket of the present invention.
Figure 18:
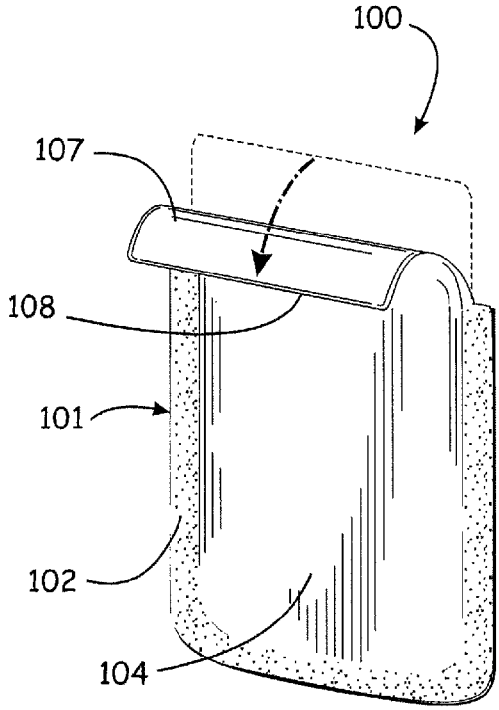
FIG. 18 is a perspective view of the pocket of FIG. 17 according to an embodiment of the present invention.
Figure 19:
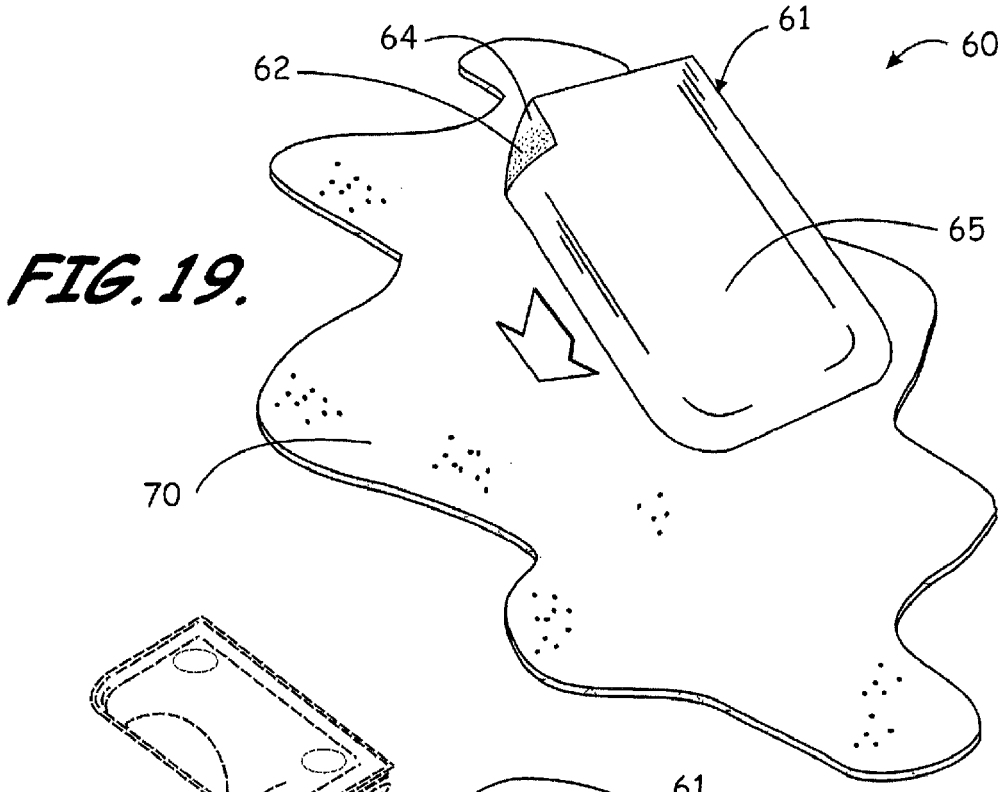
FIG. 19 is an environmental perspective view of a pocket being attached to a surface according to an embodiment of the present invention.
Figure 20:
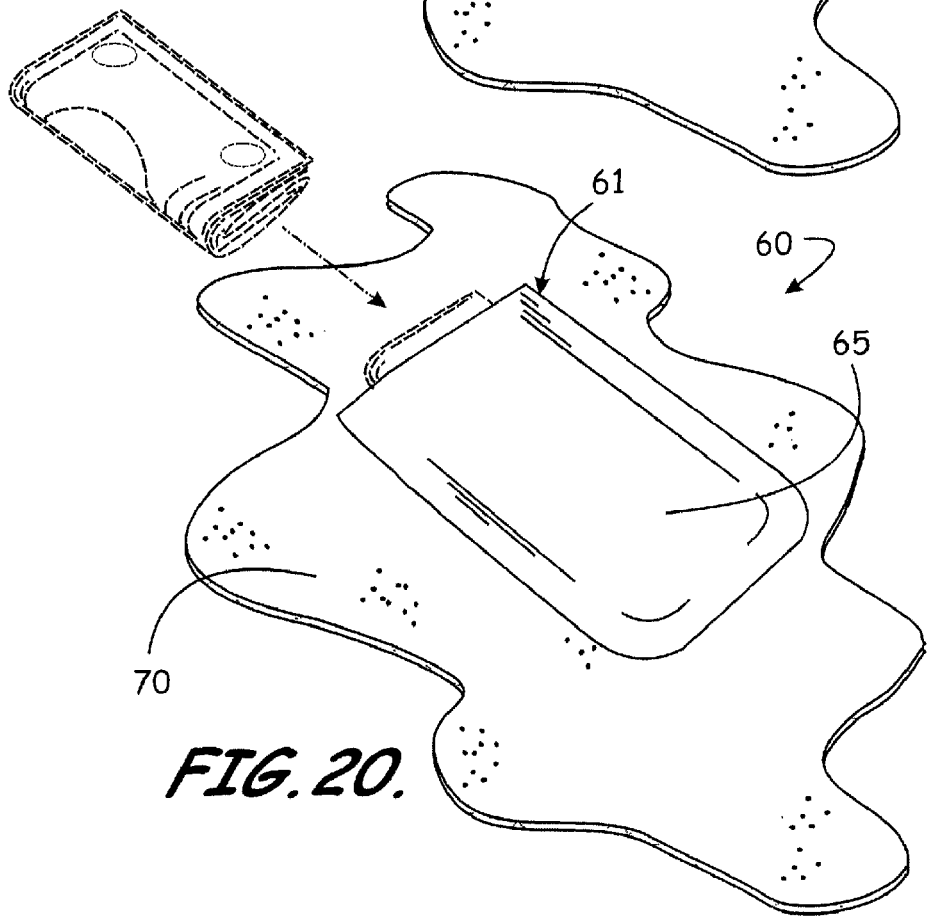
FIG. 20 is an environmental perspective view of the pocket of FIG. 19 adhered to the surface for holding an item according to an embodiment of the present invention.
Figure 21:
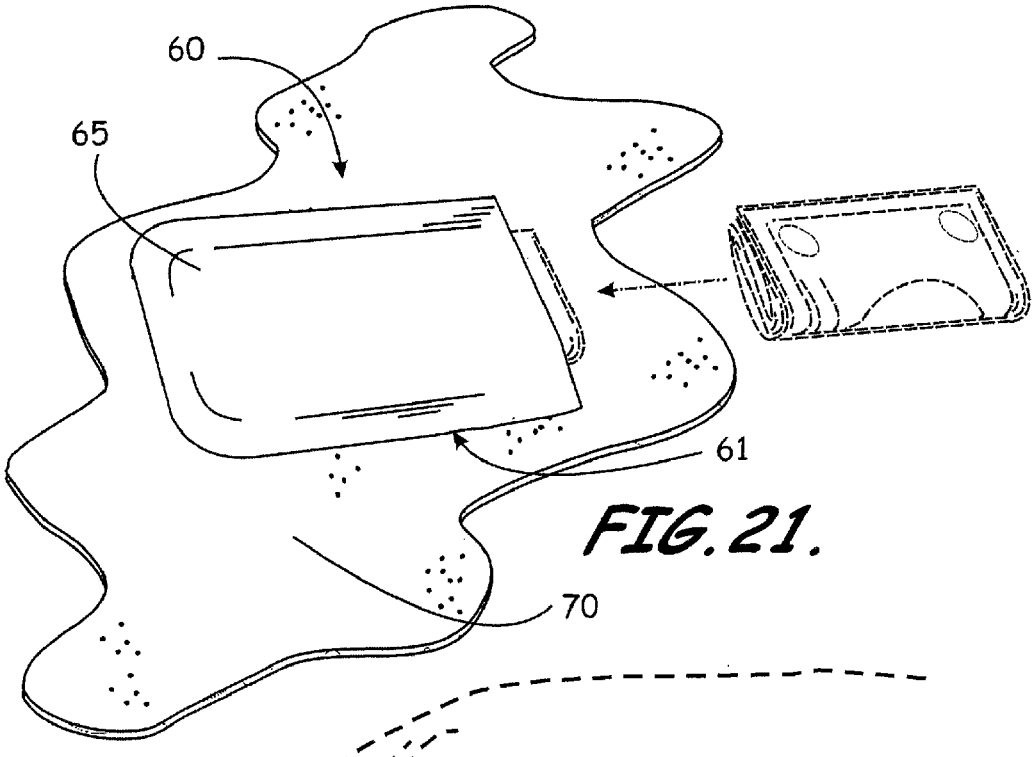
FIG. 21 is an environmental perspective view of the pocket of FIG. 19 adhered to the surface for holding an item according to an embodiment of the present invention.
Figure 22:
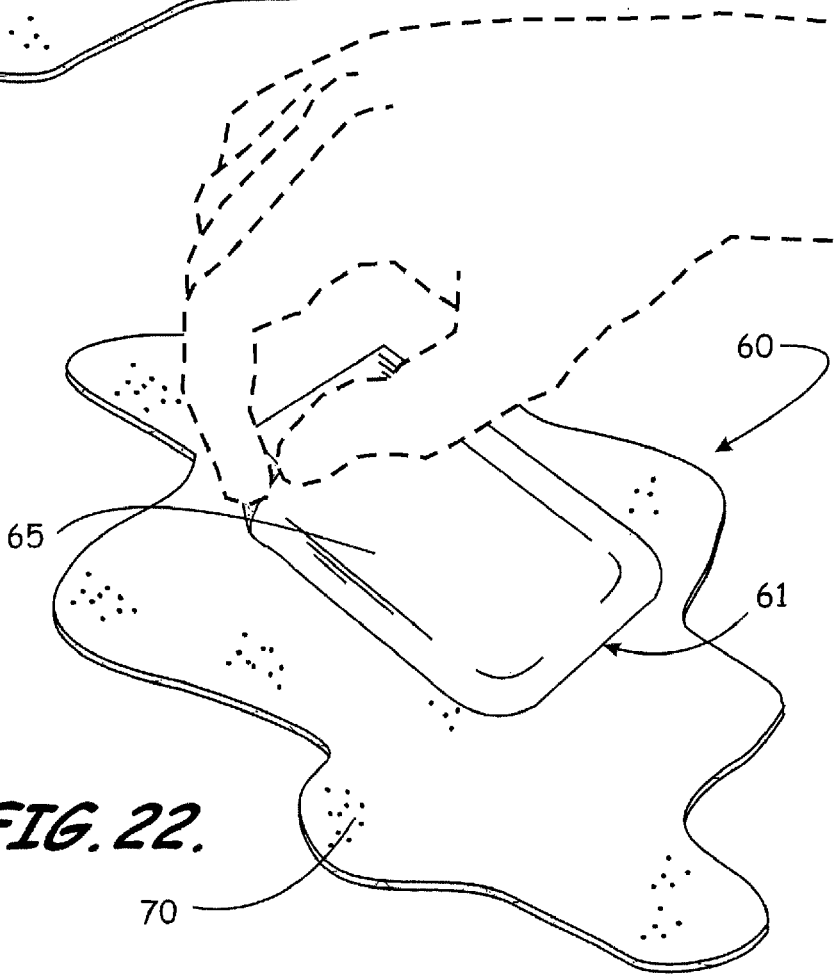
FIG. 22 is an environmental perspective view of the pocket of FIG. 19 being removed according to an embodiment of the present invention.

In an alternate embodiment of a detachable pocket 100, the detachable pocket 100 has a flange or edge portion 101 that can adhere to human skin or an article of clothing via an adhesive 102 present on the flange 101 (see FIGS. 17-18). The flange 101 can be covered by a removable non-stick backing. An upper layer 104 of the pocket 100 contacts the skin or clothing and an enclosure or pocket body 105 is formed within the pocket 100 and defined by a lower layer and the upper layer 104. The flange 101 is generally U-shaped and defines an open end at top of pocket 100 to allow, entry of items to be held in the pocket 100. In this embodiment, the upper layer 104 has a foldable portion or flap 107 with a top edge 108. The foldable portion 107 can be folded over onto lower layer to close the pocket 100. In this embodiment, the foldable portion 107 can have a button, snap, hook-loop fastener, elastic or the like, disposed on a top side thereof. The lower layer can have a corresponding a button, snap, hook-loop fastener, elastic or the like, disposed thereon to engage with same on the foldable portion 107. The flange 101, for example, in alternative embodiments can include wire, plastic or stiff fabric so that the pocket body 105 maintains a particular shape when attached to clothing. The pocket body 105 can be attached to a clothing article using a two-sided adhesive strip having the same general shape as the flange 101. The detachable pocket 100 has a generally rectangular shape but may have other shapes as well, such as, for example, triangular or semi-circular. A closed end is formed on the detachable pocket 100 opposite the selectively open end of the detachable pocket 100. The closed end of the detachable pocket 100 can have rounded edges. An end of the flange 101 that corresponds to the closed end of the detachable pocket 100 can have rounded edges. In this embodiment, the adhesive 102 is applied in a U-shape that corresponds to the shape of the flange 101.

Figure 23:
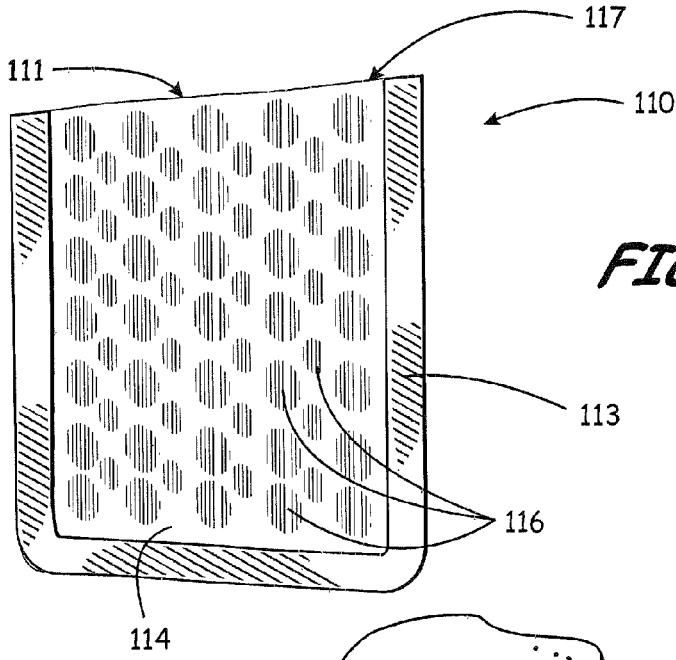
FIG. 23 is a rear perspective view of a pocket according to still yet another embodiment of a pocket of the present invention.
Figure 24:
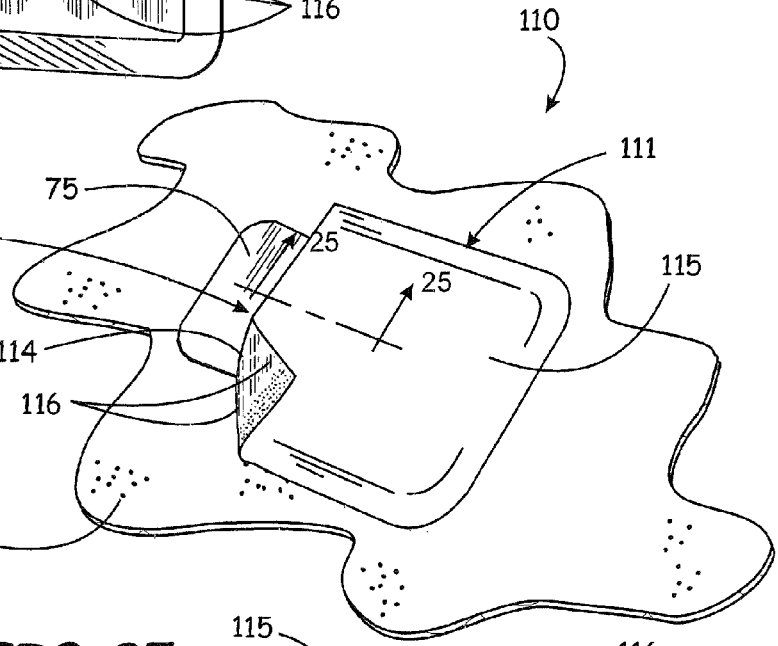
FIG. 24 is an environmental perspective view of the pocket of FIG. 23 adhered to a surface for holding an item according to still yet another embodiment of the present invention.
Figure 25:
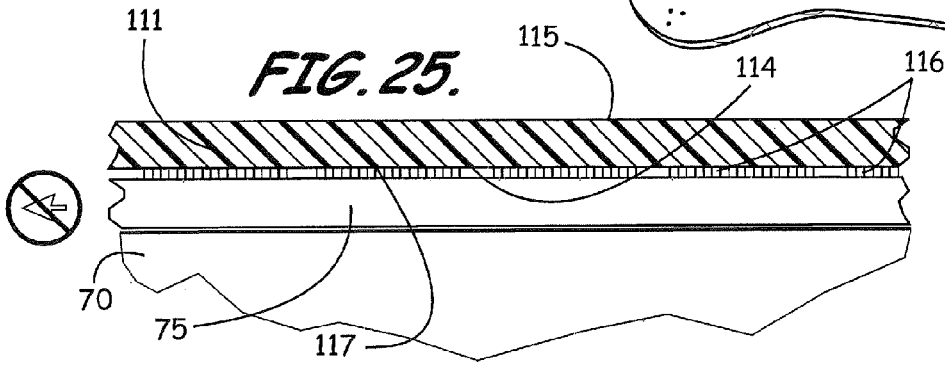
FIG. 25 is a sectional view taken along line 25-25 of the pocket of FIG. 24 according to still yet another embodiment of the present invention.
Figure 26:
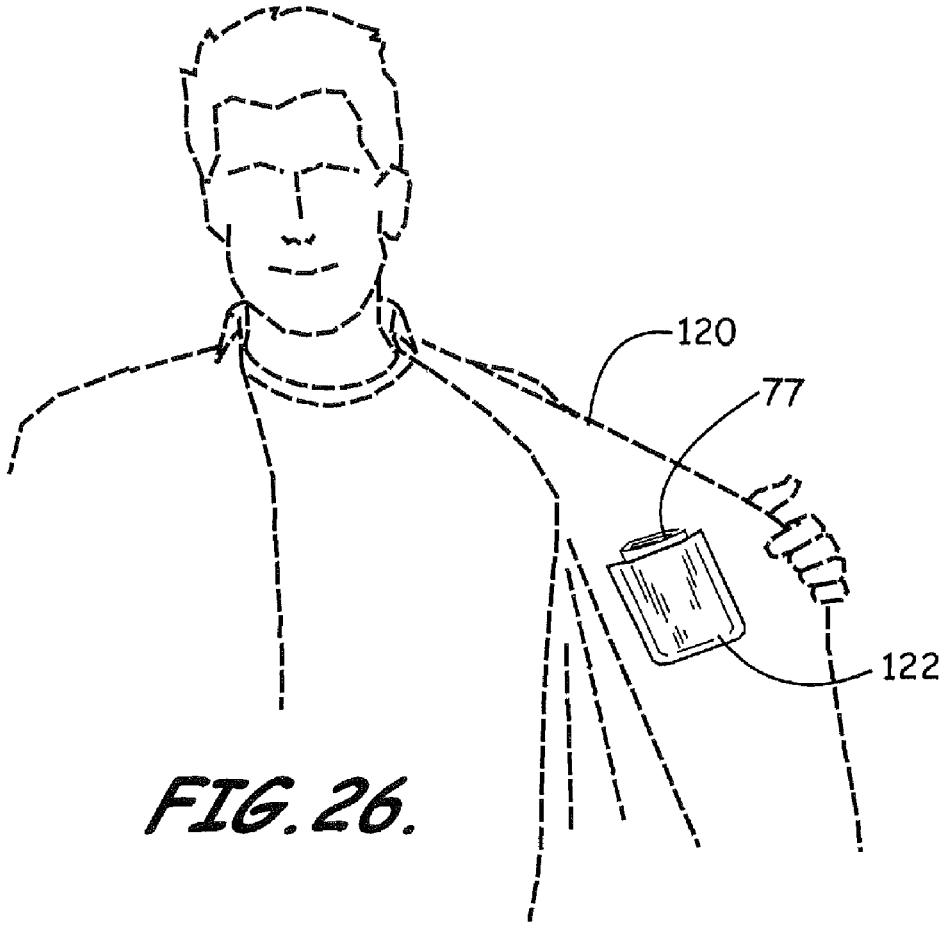
FIG. 26 is, an environmental perspective view of a pocket adhered to a clothing article according to still yet another embodiment of the present invention.
Figure 27:
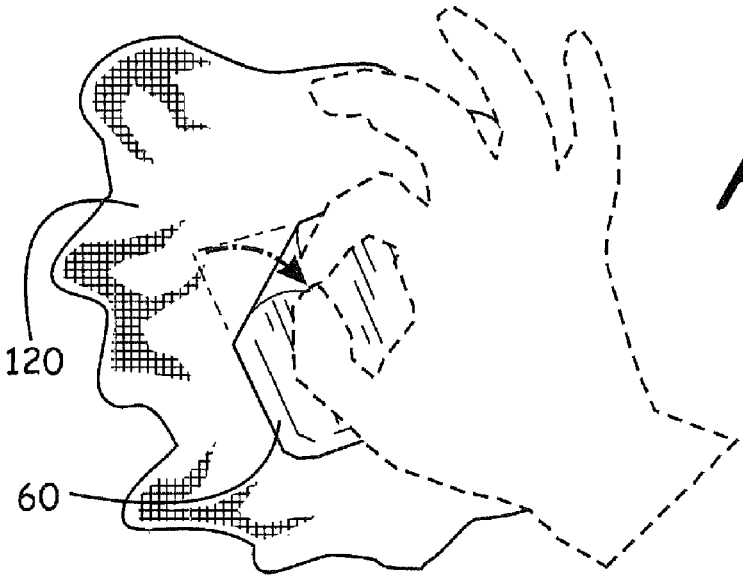
FIG. 27 is an environmental perspective view of the pocket of FIG. 26 being removed according to still yet another embodiment of the present invention.
Figure 28:
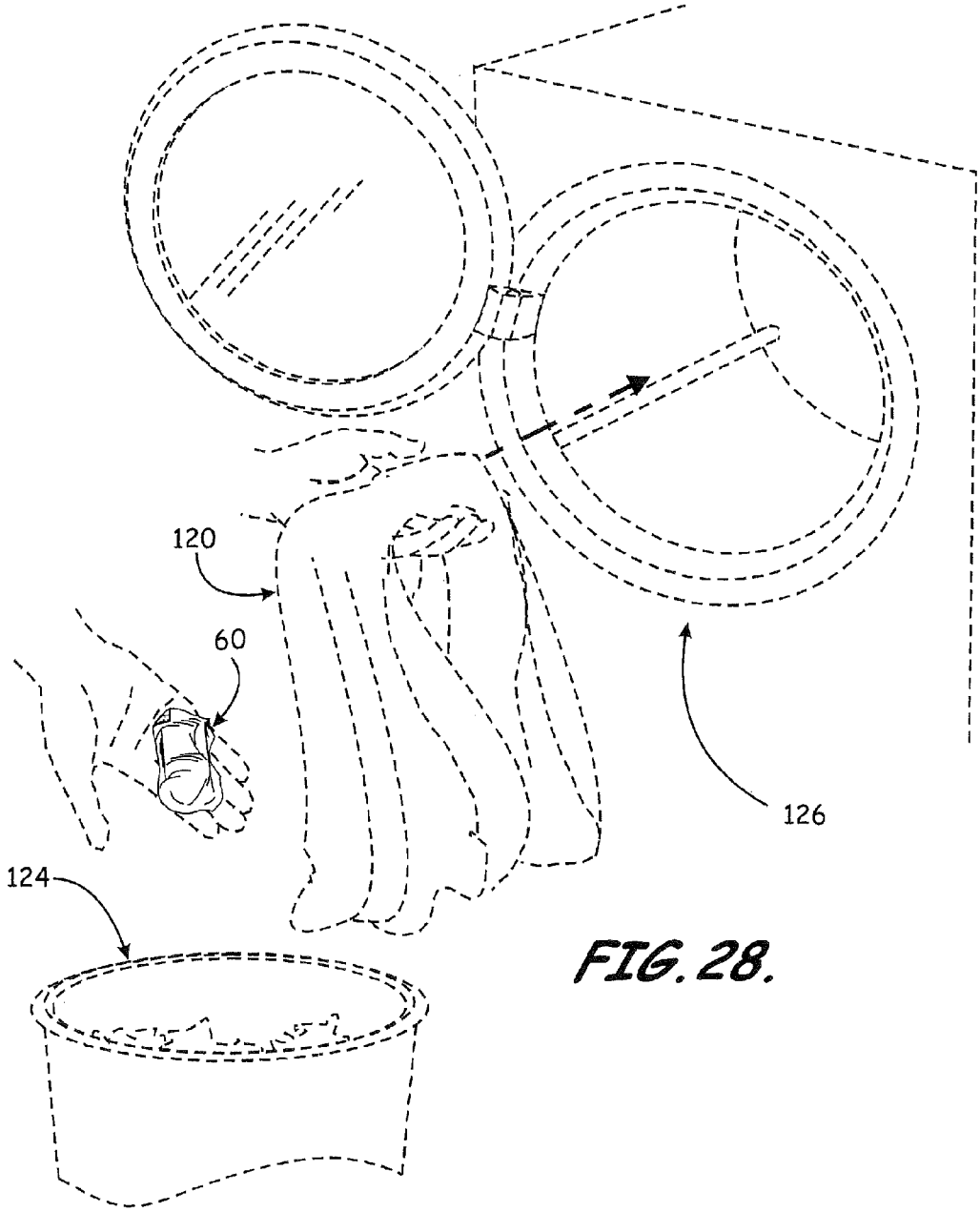
FIG. 28 is an environmental perspective view of the pocket of FIG. 26 removed from the clothing article to allow washing of clothing article according to still yet another embodiment of the present invention.

In an alternate embodiment of a detachable pocket 110, the detachable pocket 110 has a unitary pocket layer 111 with an inner surface 114 and an outer surface 115 that define a pocket body 117 (see, e.g., FIGS. 23-25). The pocket 110 has an adhesive flange or edge 113 that can adhere to human skin 70 or an article of clothing via an adhesive present on the flange 113. The adhesive flange 113 can have a surface thereof covered by a removable non-stick backing. In this embodiment, a plurality of projections or structures 116 formed on the inner surface 114 of the pocket layer 111 facilitate retaining the item 75 within the pocket 110 and prevents or reduces the risk of the item 75 sliding out of the pocket 110. In this embodiment, the plurality of projections 116 can be formed on the unitary pocket layer 111. The projections 116, however, can also be disposed on the surface on which the detachable pocket 110 is attached. The plurality of projections 116 can have varying shapes, such as circular, triangular, or rectangular. In this embodiment, the plurality of projections 116 are not formed on the edge 113 of the detachable pocket 110. The plurality of projections 116, for example, further provide an air path within the detachable pocket 110 that allows for air circulations to thereby increase breathability within the detachable pocket 110. Air can circulate into the detachable pocket 110 and around the projections 116. The plurality of projections 116, in this embodiment, come into contact with the item 75 when the item 75 is held within the detachable pocket 110. Ends of the projections 116 can be of a material that increases friction between the item 75 and the structure 116 to thereby impede movement of the item 75 out of the detachable pocket 110. The plurality of projections 116 on the pocket body 117 further can reduce suction within the pocket body 117 to facilitate removal of items held within the detachable pocket 110. Reduction of suction within the pocket body 117 is especially useful when the detachable pocket 110 becomes wet due to water or perspiration, which can make removal of items within the pocket body 117 difficult. In this embodiment, an edge of unitary pocket layer 111 that has no adhesive defines an open end to allow entry of items to be held in the detachable pocket 110. The detachable pocket 110 has a generally rectangular shape but may have other shapes as well, such as, for example, triangular or semi-circular. A closed end is formed on the detachable pocket 110 opposite the open end of the detachable pocket 110. The closed end of the detachable pocket 110 can have rounded edges. An end of the flange 113 that corresponds to the closed end of the detachable pocket 110 can have rounded edges. Alternatively, an embodiment of a detachable pocket can have one or more openings formed in the pocket body 117 to enhance air flow and reduce moisture within the pocket.

Figure 29:
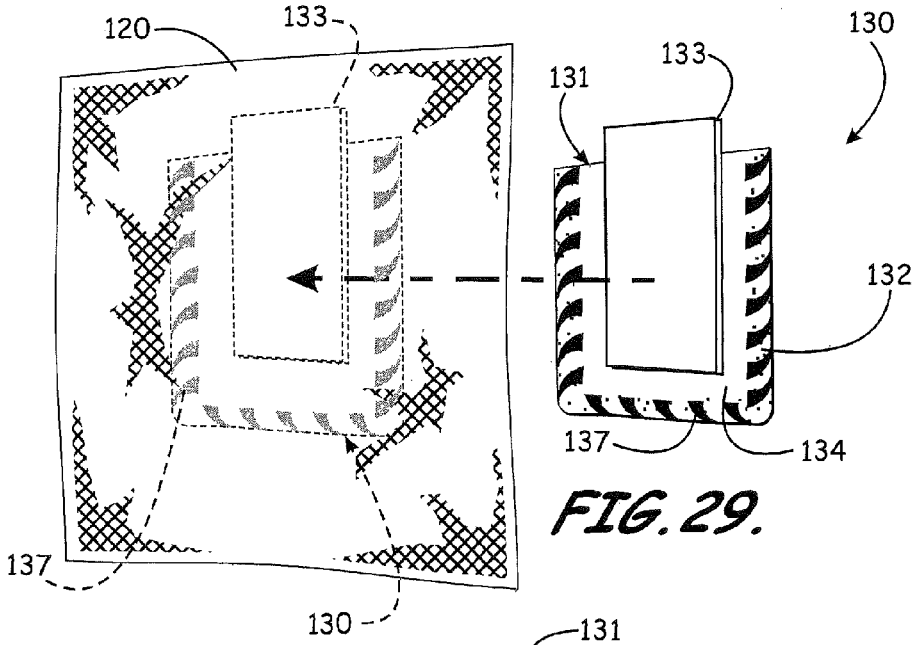
FIG. 29 is an exploded perspective view of a pocket adhered to a clothing article according to still a further embodiment of the present invention.
Figure 30:
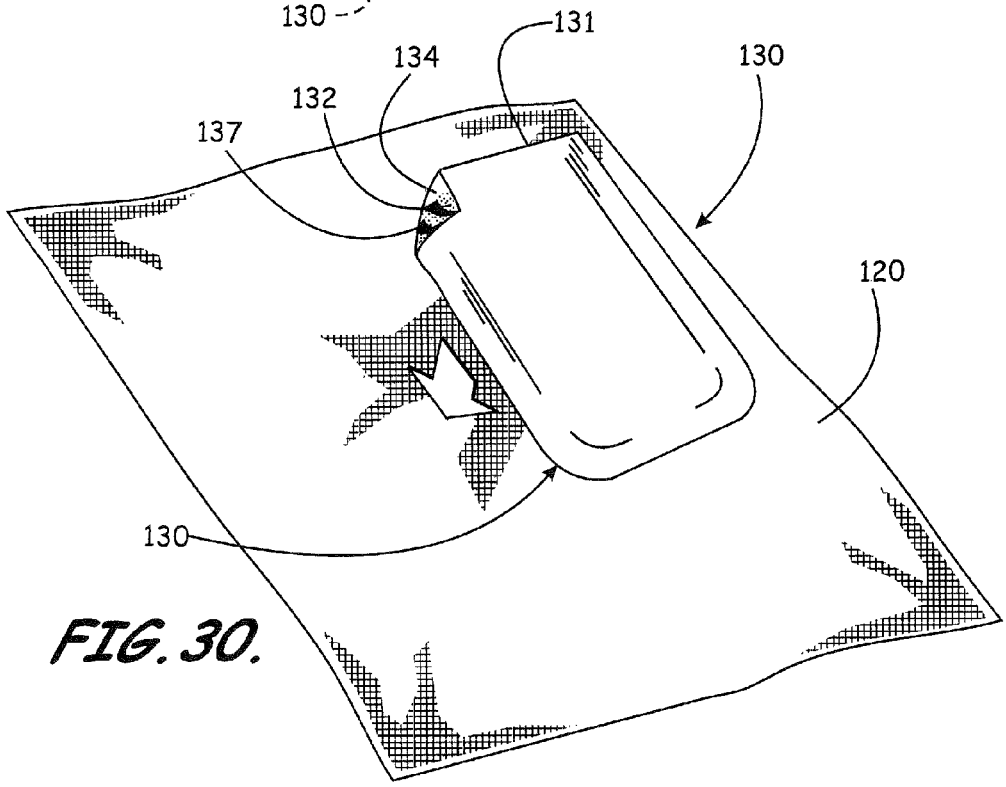
FIG. 30 is environmental perspective view of the pocket of FIG. 29 being adhered to a clothing article according to still a further embodiment of the present invention.

In an alternate embodiment of a detachable pocket 130, the detachable pocket 130 has an open end 131 to allow entry of items 133 (see, e.g., FIGS. 29-30). The pocket 130 has a flange or edge 132 and an inner surface 134. The flange 132 is generally U-shaped and has an adhesive on the flange 132 for adhering to the clothing article 120. To use the detachable pocket 130, the pocket 130 is positioned onto the article of clothing 120 and pressure is applied to the pocket 130 so the adhesive adheres to the clothing 120. In this embodiment, the upper opening 131 of the detachable pocket 130 has no adhesive and thereby allows for entry of items to be held in the detachable pocket 130. The detachable pocket 130 has a generally rectangular shape but may have other shapes as well, such as, for example, triangular or semi-circular. A closed end is formed on the detachable pocket 130 opposite the open end 131 of the detachable pocket 130. The closed end of the detachable pocket 130 can have rounded edges. An end of the flange 132 that corresponds to the closed end of the detachable pocket 130 can have rounded edges. In this embodiment, indicia 137, such as a logo or design, is applied to the flange 132. The indicia 137 can show through the article of clothing 120 when the clothing 120 is thin or translucent enough.

Figure 31:
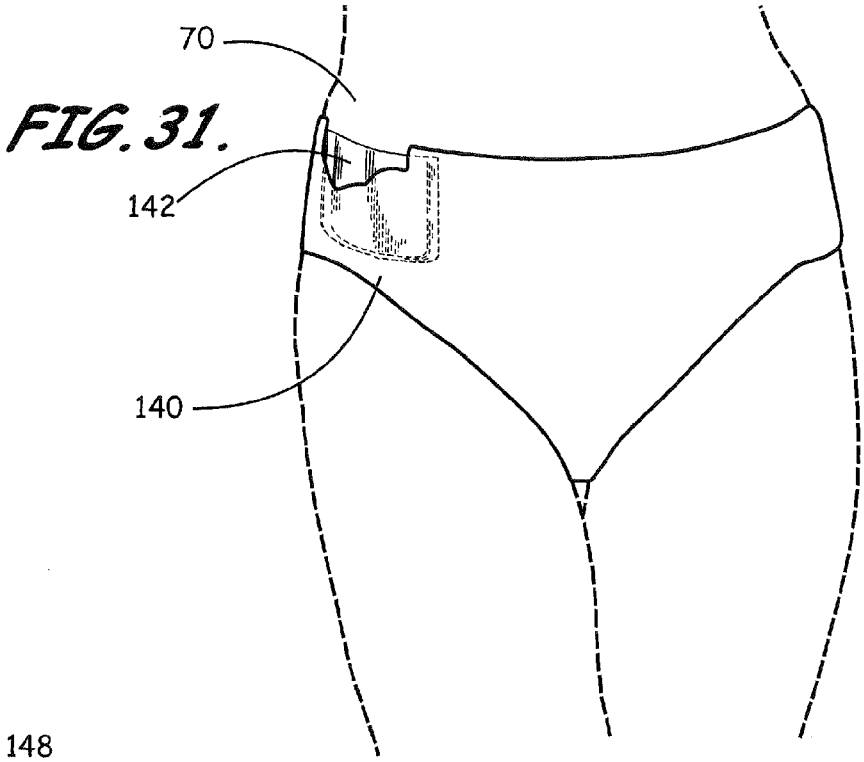
FIG. 31 is an environmental perspective view of a pocket adhered to a person's skin according to yet an additional embodiment of the present invention.
Figure 32:
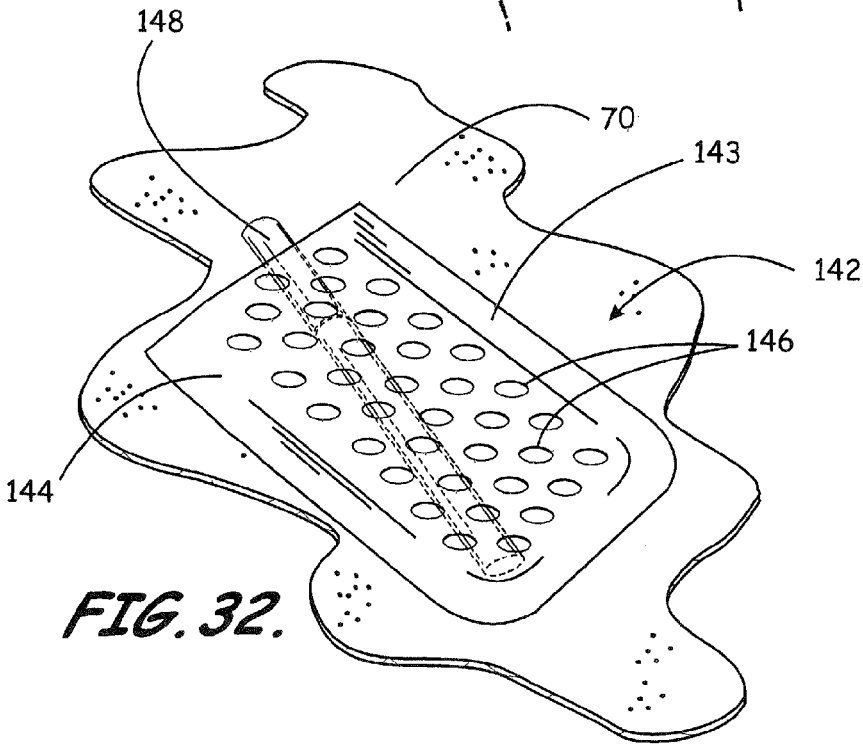
FIG. 32 is an environmental' perspective view of the pocket of FIG. 31 adhered to the person's skin according to yet an additional embodiment of the present invention.

In an alternate embodiment of a detachable pocket 142, the detachable pocket 142 has an edge or flange 143 and a pocket body 144 (see, e.g., FIGS. 31-32). The pocket 142 can have an adhesive on the flange 143 that can adhere to the human skin 70. Alternatively, a back side of the detachable pocket 142 can be completely coated with an adhesive to provide additional adhesive surface area and thereby increase adherence to the human skin 70. In this embodiment, a plurality of openings 146 can be formed on the pocket body 144. The plurality of openings 146 can have varying shapes, such as circular, triangular, or rectangular. In this embodiment, the plurality of openings 146 are not formed on the edge 143 of the detachable pocket 142. The plurality of openings 146 communicate an outer surface of the pocket body 144 with an inner surface of the pocket body 144 where items are held. Further, the plurality of openings 146 can increase breathability within the detachable pocket 142 by facilitating the circulation of air into the detachable pocket 142 via the plurality of openings 146 and an open end of the detachable pocket. The open end of the detachable pocket allows items to be introduced into the detachable pocket 142. The plurality of openings 146 on the pocket body 144 further can reduce suction within the pocket body 144 to facilitate removal of items held within the detachable pocket 142. Reduction of suction within the pocket body 144 is especially useful when the detachable pocket 142 becomes wet due to water or perspiration, which can make removal of items within the pocket body 144 difficult. To facilitate removal of the detachable pocket 142 from the person's skin 70, a removal tool 148 can be inserted into the open end of the detachable pocket 142. An end of the removal tool 148 that protrudes from the open end of the detachable pocket 142 can then be pulled in a motion away from the human skin 70 to detach the detachable pocket 142 from the human skin 70. The removal tool 148 may have a cylindrical shape with a diameter that generally corresponds to the open end of the detachable pocket. Alternatively, the removal tool 148 could have a different shape such as a block. The detachable pocket 142 has a generally rectangular shape but may have other shapes as well, such as, for example, triangular or semi-circular. A closed end is formed on the detachable pocket 142 opposite the open end 131 of the detachable pocket 142. The closed end of the detachable pocket 142 can have rounded edges. An end of the flange 143 that corresponds to the closed end of the detachable pocket 142 can have rounded edges.

Alternatively, the detachable pocket 142 can have an adhesive on the flange 143 that can adhere to an interior portion of an article of clothing 140, such as an undergarment or swimsuit (see, e.g., FIGS. 31-32). Alternatively, a back side of the detachable pocket 142 can be completely coated with an adhesive to provide additional adhesive surface area and thereby increase adherence to the article of clothing 140. The plurality of openings 146 can be formed on the pocket body 144, as previously discussed. The plurality of openings 146 can have varying shapes, such as circular, triangular, or rectangular. In this embodiment, the plurality of openings 146 are not formed on the edge 143 of the detachable pocket 142. The plurality of openings 146 communicate an outer surface of the pocket body 144, which is in contact with the human skin 70, with an inner surface of the pocket body 144 where items are held. Further, the plurality of openings 146 increase breathability within the detachable pocket 142 by facilitating the circulation of air into the detachable pocket 142 via the plurality of openings 146 and the open end of the detachable pocket. The open end of the detachable pocket allows items to be introduced into the detachable pocket 142, which is attached to the interior portion of the article of clothing 140. The plurality of openings 146 on the pocket body 144 further can reduce suction within the pocket body 144 to facilitate removal of items held within the detachable pocket 142. Reduction of suction within the pocket body 144 is especially useful when the detachable pocket 142 becomes wet due to water or perspiration, which can make removal of items within the pocket body 144 difficult. To facilitate removal of the detachable pocket 142 from the article of clothing 140, a removal tool 148 can be inserted into the open end of the detachable pocket 142. An end of the removal tool 148 that protrudes from the open end of the detachable pocket 142 can then be pulled in a motion away from the article of clothing 140 to detach the detachable pocket 142 from the article of clothing 140. The removal tool 148 may have a cylindrical shape with a diameter that generally corresponds to the open end of the detachable pocket. Alternatively, the removal tool 148 could have a different shape such as a block. As previously discussed, the detachable pocket 142 has a generally rectangular shape but may have other shapes as well, such as, for example, triangular or semi-circular. A closed end is formed on the detachable pocket 142 opposite the open end 131 of the detachable pocket 142. The closed end of the detachable pocket 142 can have rounded edges. An end of the flange 143 that corresponds to the closed end of the detachable pocket 142 can have rounded edges.

Alternatively, as will be understood by those skilled in the art, embodiments of a detachable, as well as disposable, pocket can include other decorative material 168, 184, such as lace, sparkles, or other add-ons as will be understood by those skilled in the art, to enhance appearance, attract the eyes of a viewer in that direction, add style, or as otherwise desired (see, e.g., FIGS. 37-39). These can be included on the outer surface, the open end, closed end, or other locations on a detachable pocket as desired. An embodiment of a detachable pocket 160 can also include a flange 165 as a portion of or as a separate section of a pocket body 166. Also, a detachable pocket 160, 180, for example, can have decorative material 168, 184 connected to the unitary pocket layer 182 and be adapted to be positioned on an inner surface of clothing (see, e.g., FIG. 39), as well as on a wearer's skin 70 (see, e.g., FIG. 37), when positioned on a wearer so that the decorative material 168, 184 is readily viewable by a wearer and others when the disposable pocket is attached to the inner surface and extends beyond peripheries of the inner surface (see, e.g., FIG. 39). Notably, the decorative material 184 can be attached, such as with adhesive or with fabric welding, bonding, or stitching, or be an unitary extension of an end portion of a unitary pocket layer 182, such as an open end through which items are inserted, or other locations as desired and as understood by those skilled in the art.

Figure 35:
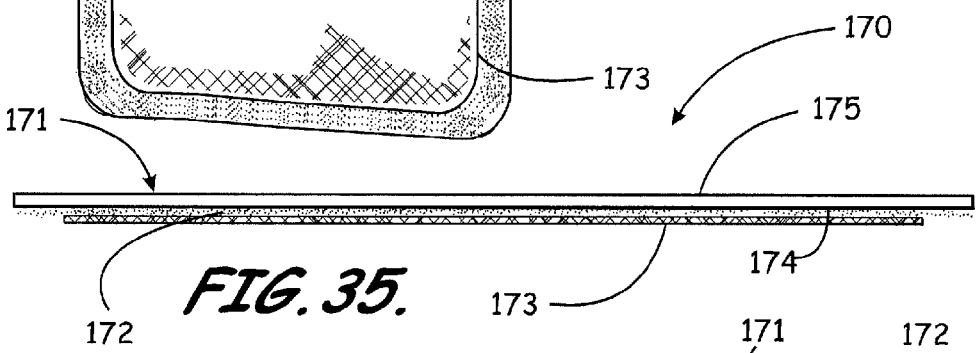
FIG. 35 is a sectional view of the disposable pocket of FIG. 34 taken along line 35-35 according to still yet a further embodiment of the present invention.
Figure 36:
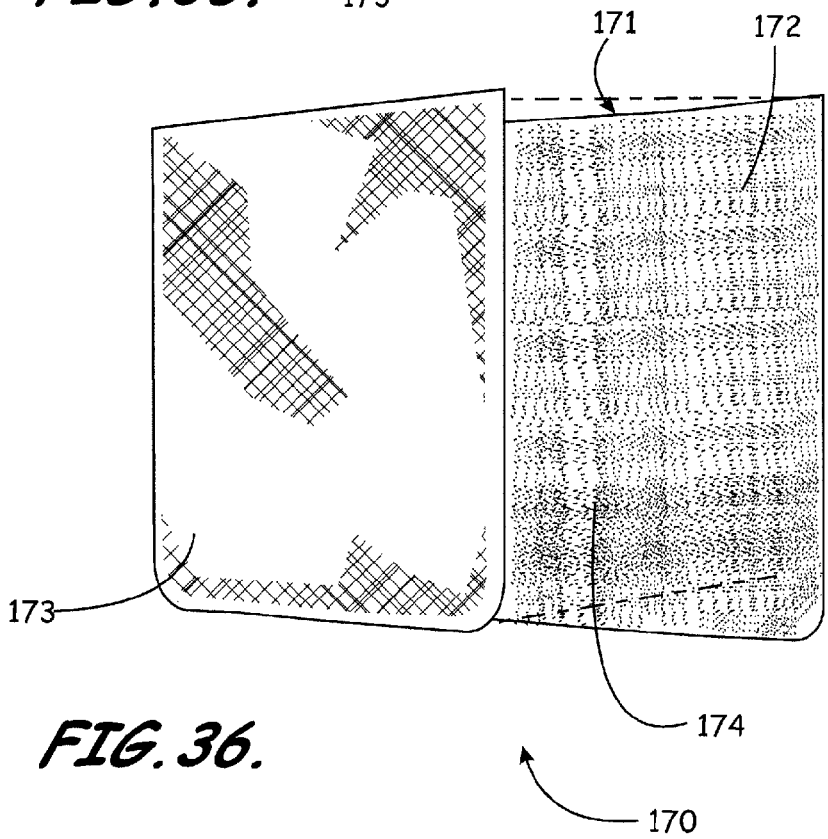
FIG. 36 is an exploded perspective view of a disposable pocket according to an embodiment of the present invention.

Still alternatively, as will be understood by those skilled in the art, embodiments of a detachable, as well as disposable, pocket 170 can be formed of two pocket layers 173, 174 and then adhered to a surface (see, e.g., FIGS. 34-36) so that items can be inserted through an open end 171. Also, a layer of fabric could be adhered to a pocket body or pocket layer to assist in maintaining items in the pocket or to assist in releasing items from the pocket. Further, a fabric layer can be adhered to the pocket layer to reduce cost of manufacturing one or more pockets such as to blocking a section of material with fabric to prevent or reduce risk of adherence to a surface to which there is no desire for the pocket to attach. Embodiments of one or more of detachable pockets, for example alone or as one of a plurality of detachable pockets in a kit, can have a first pocket layer 174 and a second fabric layer 173 having adhesive 172 on a surface opposite to an inner surface 175 of the first pocket layer 174 and adapted to be adhered to one or more of: (a) an article of clothing; (b) a person's skin; and (c) both an article of clothing and a person's skin.

In a method of attaching or using the detachable pocket 60, the detachable pocket 60 can be selected by the user and removed from the kit 10, 20, 30, 40, or 50. The user can then remove the packaging surrounding the detachable pocket 60. The detachable pocket 60 can be positioned on a surface, such as the human skin 70 or an article of clothing 120. The detachable pocket 60 can be adhered to the human's skin 70 by applying pressure to the detachable pocket 60. An adhesive on the detachable pocket 60 facilitates adherence to the surface. Further, the pressure can be applied to a flange 63 along the edges of the pocket 60. This allows the adhesive 62 on the flange 63 to adhere to the skin 70 or clothing 120. A non-stick backing on an adhesive layer of either the flange of the detachable pocket 60 or on the detachable pocket body can be removed prior to positioning the detachable pocket 60 on the surface. Once attached to the skin 70, a person can introduce items, such as money, into the pocket 60 for holding within the pocket body 65. When the person desires, the person can remove the item from the pocket 60 and apply force to the pocket 60 to remove it from the skin. For example, the person may pull on a corner of the pocket 60 to thereby peel the detachable pocket 60 off from the skin. Alternatively, a removal tool 148 can be inserted into the open end of the detachable pocket 60 and can then be pulled away from the surface to remove the detachable pocket 60. Alternatively, the detachable pocket 60 may be part of a plurality of detachable pockets 60 that are organized within the container 16 of the kit 10, 20, 30, 40, or 50 for ease of selection. The detachable pockets 60 can be organized according to, for example, size, indicia, adherence to skin, or adherence to clothing.

In a method of attaching the detachable pocket 60, the detachable pocket 60 can be adhered to the inside of a clothing article 120, such as a jacket. Once attached to the article of clothing 120, an item 122 can be introduced into the pocket 60. When the person desires to place the article of clothing 120 into a washing machine 126 for washing, the person can pull on a corner of the pocket 60 to remove it from the article of clothing 120 and dispose of the pocket 60 in a waste basket 124.

As illustrated in FIGS. 1-34, embodiments of methods of attaching, removing, using, and wearing detachable pockets are shown. A method of attaching a detachable pocket, for example, includes removing a detachable pocket from a kit, removing packaging from the detachable pocket, positioning the pocket on a surface, and applying pressure to the detachable pocket. The method can also include removing non-stick backing on an adhesive layer to adhere a flange or other portion of the detachable pocket having adhesive thereon to the surface. The detachable pocket, in an embodiment, can have a pocket body preferably formed of a unitary material substantially throughout, as will be understood by those skilled in the art, and having adhesive on a surface thereof so that two or more, and preferably three or more, side edges contact the surface, e.g., skin or clothing, and one side edge portion remains open to define an open end. The method further can include inserting one or more items into the pocket through the open end. Further, an example of attaching such a pocket can be to an inner surface of clothing that faces or is to face a wearers body when positioned thereon, such as illustrated, and also can be on a skin of a wearer so that clothing covers or obfuscates all or significant portions of the detachable pocket. Some types of clothing, such as t-shirts, undergarments, swimsuits, and blouses, can allow designs or other indicia, as well as lace or other add-ons and additions to the pocket to be seen or viewed by a wearer or others through the clothing or in peripheral portions of the clothing.

In a method of attaching the detachable pocket 150, a detachable pocket 150 can be adhered to the human's skin 70, for example on the chest, and can have indicia 152, such as a design or emblem. The detachable pocket 150 can have an open end where no adhesive is present to allow for insertion of items. A closed end of the detachable pocket 150 is opposite to the open end of the detachable pocket 150. A person can then put a shirt 154 on while allowing the detachable pocket 150 to remain below the shirt 154. The indicia 152 on the detachable pocket can show through the shirt 154 when the shirt 154 is sufficiently thin or translucent.

Figure 33A:
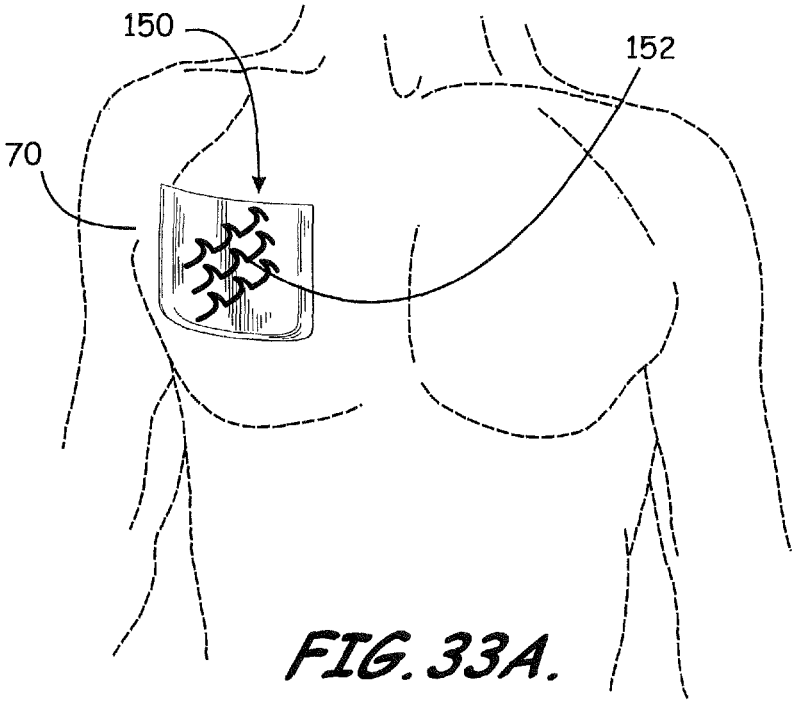
FIGS. 33A-33B are environmental perspective views of a pocket adhered to a person's skin according to yet an additional embodiment of the present invention.
Figure 33B:
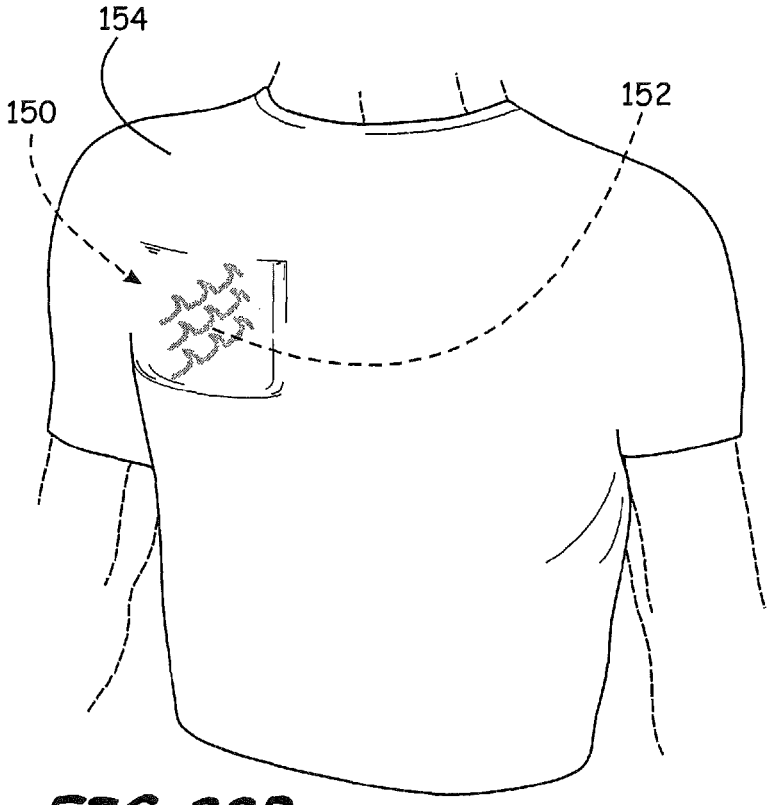
Figure 34:
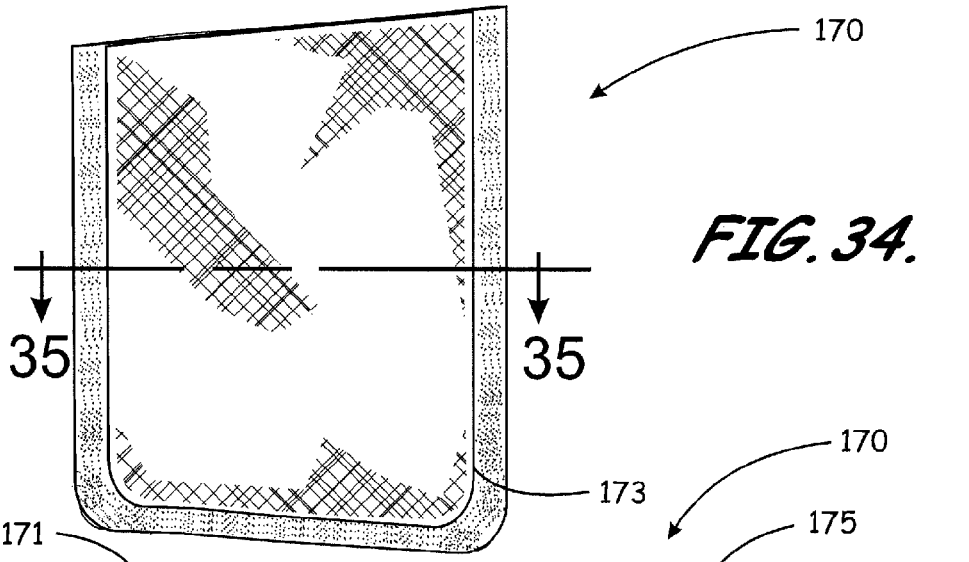
FIG. 34 is a perspective view of the pocket according to yet an additional embodiment of the present invention.

Alternatively, the detachable pocket 150 can be adhered to the interior of the article of clothing 154 at a location on the clothing 154 corresponding with a desired body part, such as the chest (see, e.g., FIGS. 33A-33B). The detachable pocket 150 can have the indicia 152 as previously discussed. The detachable pocket 150 can have an open end where no adhesive is present to allow for insertion of items. A closed end of the detachable pocket 150 is opposite to the open end of the detachable pocket 150. A person can then put a shirt 154 on with the detachable pocket attached inside the shirt 154. The indicia 152 on the detachable pocket 150 can show through the shirt 154 when the shirt 154 is sufficiently thin or translucent.

In a method of attaching the detachable pocket 60, the detachable pocket 60 is capable of being adhered to a person's skin 70, such as at the hip, using an adhesive 62 (FIG. 8) already present on the detachable pocket 60. The adhesive 62 can be moisture resistant so perspiration or water does not cause the pocket 60 from falling off. The pocket 60 can be used underneath a swimsuit or under garment 140. The detachable pocket 60 can be allowed to breathe via the plurality of openings 146 formed on the pocket body 144.

In a method of attaching the detachable pocket 60, a two-sided adhesive strip can be removed from the kit 10, 20, 30, 40, or 50. A non-stick backing on one side of the two-sided strip can then be removed. The two-sided adhesive strip, or flange, can then be positioned on the surface, such as the human skin 70 or an article of clothing 120, as desired. Once the two-sided adhesive strip is in place, a second non-stick backing on an opposing side of the two-sided adhesive strip is removed. A flange of the pocket body 84 on the detachable pocket 60 or the detachable pocket 60 itself can be adhered to the adhesive strip.

In a method of removing the detachable pocket 60, the detachable pocket 60 can be removed from the surface by pulling a corner of the detachable pocket from the surface. Alternatively, for example, a method of removing the detachable pocket 60, the detachable pocket 60 can be removed from the surface by inserting a removal tool 148 and pulling on the removal tool to remove the detachable pocket 60 from the surface. In another method of removing the detachable pocket 60, the detachable pocket 60 can be removed from the surface by applying a solvent to the detachable pocket 60 to thereby release the adhesive and allow the detachable pocket 60 to be removed from the surface. Upon removing of the detachable pocket 60, for example, the detachable pocket 60 can be disposed of, for example, into a waste basket.

As will be understood by those skilled in the art, embodiments of a detachable pocket can include leaving the pocket on permanently or semi-permanently, such as clothing, if desired.

Embodiments of kits, detachable pockets, and methods have been described and illustrated herein that allow wearers and other users to address issues such as when many types of clothing have no readily accessible location for a pocket, make having a pocket in a prominent location awkward, unsightly, or not otherwise providing as much style to the clothing. As a result, a person wearing various types of clothing can find themselves in locations with money, cell phones, credit, identification, or other types of cards, or other items, including personal items, and having no place on their person to readily store the items. The kits, detachable pockets, and methods provide elegant solutions to such situations to thereby reduce inconvenience and risk to the person in some situations. These embodiments of detachable, as well as disposable, pockets also are readily designed or constructed to attach to a person's skin.

Embodiments of kits, detachable pockets, and methods have been described and illustrated so that many situations are address such as when a person desires an option to attach a pocket to clothing or their skin in a location of which the wearer gets to choose, desires to wear the same piece of clothing at times with a pocket and at times without a pocket, and desires to be able to readily remove a pocket to allow washing of the clothing without the pocket. Such embodiments also allow a wearer to attach such a pocket on inner surfaces of clothing or on outer surfaces of a wearer's skin to keep a pocket and the personal items therein hidden from others view or otherwise concealed. These embodiments of a kit, detachable pockets and methods allow a wearer or user readily to dispose of or throw away a pocket after one or a few uses as the pocket may be soiled, not have the same texture, feel, resiliency, or not have the same holding strength for items.

Embodiments of kits, detachable pockets, and methods have been described and illustrated that provide pockets shaped and sized for particular commonly shaped and sized personal items such as a cell phone, personal digital assistant, smart phone, credit card, money or other specifically shaped items and to have a choice or selection of what type of pocket to use in various situations that can be readily detached once attached and readily dispose of thereafter if desired. These embodiments also include detachable pockets that have decorative materials, such as lace, sparkles, patterns, or the like, attached to such detachable pockets to allow a wearer to add style to clothing or appearance if the wearer desires that the pocket itself or decorative material to be viewable by others such as when positioned to underlie clothing or other arrangements.

The present application relates to, claims benefit of, and claims priority to U.S. Provisional Patent Application Ser. No. 61/566,423 titled "Kit of a Plurality of Detachable Pockets, Detachable Pocket, and Associated Methods" and which is incorporated herein by reference in its entirety.

Many modifications and other embodiments of the invention will come to the mind of those skilled in the art having the benefit of the teachings presented in the foregoing descriptions and the associated drawings. Therefore, it is to be understood that the invention is not to be limited to the illustrated embodiments disclosed, and that modifications and other embodiments are intended to be included within the scope of the appended claims.

That claimed is:

1. A kit of a plurality of detachable pockets, the kit comprising:

a container;

the plurality of detachable pockets positioned within the container, each of the detachable pockets being adapted to hold a personal item of a wearer therein when the detachable pocket is positioned on a surface associated with the wearer and to readily attach to the surface with strength to retain the personal item therein and readily detach from the surface when removal is desired by application of removable and releasable pressure from a hand of a wearer, and each of the detachable pockets having a pocket body formed of a readily disposable material and adapted to be adhered to one or more of: (a) an article of clothing; (b) a person's skin; and (c) both an article of clothing and a person's skin, such adherence being caused by an adhesive already present on the pocket body; and packaging material being positioned so that each individual one of the plurality of detachable pockets has a separate portion of the packaging material that substantially encases the individual one of the plurality of pockets when in the container, the packaging material being different from the container, and so that removal of the individual packaging material from the container also removes the individual pocket of the plurality of detachable pockets from the container.

2. A kit as defined in claim 1, wherein each of the plurality of detachable pockets further comprises a pocket body formed of a unitary pocket layer and having a flange defined by one or more edge portions of the pocket body, an adhesive material positioned on the flange to adhere to a surface, and a non-adhesive edge that forms an open end against the surface to receive items therethrough to be positioned substantially within the confines of the pocket body.

3. A kit as defined in claim 2, wherein one or more of the plurality of detachable pockets positioned within the container has a first size and shape different than a second size and shape of one of more of the plurality of detachable pockets positioned within the container, and wherein each of the first size and shape and the second size and shape substantially correspond to a size and shape of one or more of the following items: a cell phone, a personal digital assistant, a smart phone, money, folded money, credit card, debit card, identification card, a container of liquid, powder, lotion, or gel, and so that a first personal item readily inserts into the detachable pocket having the first size and shape and a second and different personal item readily inserts in the detachable pocket having the second size and shape.

4. A kit as defined in claim 3, wherein the flange is formed integral with the unitary pocket body and generally has a substantially U-shape to thereby allow insertion of one or more items into the detachable pocket within the open portion of the U-shape, and wherein the unitary pocket layer has an adhesive present along three edge portions of the substantially U-shape to adhere to a surface, said edges being formed to define the substantially U-shape, the open end portion of the substantially U-shape and substantial medial portions of the unitary pocket layer having no adhesive thereon to thereby allow insertion and removal of items therein when the unitary pocket layer is adhered to a surface.

5. A kit as defined in claim 4, wherein the container has a flap for opening and closing a side of the container, the side allowing access to organize the plurality detachable pockets within the container, and wherein the container includes a plurality of sub-containers having an open end and located within the container, the open end capable of receiving the detachable pockets, organize the plurality of detachable pockets.

6. A kit as defined in claim 5, wherein each of the plurality and detachable pockets has a generally rectangular shape with rounded corners at a closed end of the pocket, wherein each of the plurality of detachable pockets has a width that measures less than a length of the detachable pockets, and wherein one or more of the detachable pockets further comprises decorative material connected to the unitary pocket layer and adapted to be positioned on an inner surface of clothing when positioned on a wearer so that the decorative material is readily viewable by a wearer and others when the detachable pocket is attached to the inner surface and extends beyond peripheries of the inner surface.

7. A kit as defined in claim 1, wherein one or more of the plurality of pockets includes a flange associated with the pocket body, and wherein a surface of the flange adheringly mates with two or more edge portions of the pocket body, the surface of the flange generally corresponding in shape with the two or more edge portions of the pocket body.

8. A kit as defined in claim 2, wherein the pocket body includes a unitary pocket layer formed of a substantially same fabric material throughout, and wherein the flange has an adhesive present on both front and rear facing surfaces for adhering to the unitary pocket layer along one facing surface thereof and adhering to another surface on the other facing surface.

9. A kit as defined in claim 8, wherein the unitary pocket layer has an adhesive present along two or more edges to adhere to a non-adhesive side of the flange, and wherein the unitary pocket layer has an adhesive edge that forms a closed end against the flange, the closed end being opposite the open end.

10. A kit as defined in claim 2, wherein one or more of the plurality of detachable pockets has a flap portion disposed along the open end thereof, the flap portion capable of being folded to thereby close the one or more of the plurality of detachable pockets.

11. A kit as defined in claim 1, further comprising one or more of: (a) a plurality of two-sided adhesive strips positioned within the container for attaching to an article of clothing and to one or more of the plurality of detachable pockets; and (b) a cleaning cloth positioned with the container to clean a person's skin before attachment or after detachment of one of the plurality of detachable pockets.

* * * * *